United States Patent [19]

Sugai et al.

[11] Patent Number: 5,019,249

[45] Date of Patent: May 28, 1991

[54] APPARATUS FOR HANDLING SHEETS OF PAPER

[75] Inventors: Kazunari Sugai, Shiunjimachi; Osamu Takeuchi; Yasuyuki Wakasa, both of Nakajomachi; Kenji Taguchi, Shibatashi; Toshio Ogata, Nakajomachi, all of Japan

[73] Assignee: Hitachi, Ltd., Tokyo, Japan

[21] Appl. No.: 245,209

[22] Filed: Sep. 16, 1988

[30] Foreign Application Priority Data

| | | | |
|---|---|---|---|
| Sep. 18, 1987 | [JP] | Japan | 62-232187 |
| Mar. 11, 1988 | [JP] | Japan | 63-56063 |
| Apr. 6, 1988 | [JP] | Japan | 63-82918 |

[51] Int. Cl.[5] ..... B07C 5/38; G07D 7/00

[52] U.S. Cl. ..... 209/534; 235/379; 902/12

[58] Field of Search ..... 209/534; 194/206; 235/379; 377/8; 902/11, 12

[56] References Cited

U.S. PATENT DOCUMENTS

| | | | |
|---|---|---|---|
| 3,675,816 | 7/1972 | Bourke, II et al. . | |
| 4,017,004 | 4/1977 | Onoe et al. | 271/9 X |
| 4,282,892 | 8/1981 | Burnside . | |
| 4,534,373 | 8/1985 | Glinka et al. . | |
| 4,566,684 | 1/1986 | Gysling . | |
| 4,820,909 | 4/1989 | Kawauchi et al. | 902/12 X |

FOREIGN PATENT DOCUMENTS

| | | | |
|---|---|---|---|
| 3242789 | 3/1984 | Fed. Rep. of Germany | 209/534 |
| 63-51228 | 3/1988 | Japan | 209/534 |
| 63-66037 | 3/1988 | Japan | 209/534 |

*Primary Examiner*—Michael S. Huppert
*Assistant Examiner*—Edward M. Wacyra
*Attorney, Agent, or Firm*—Fay, Sharpe, Beall, Fagan, Minnich & McKee

[57] ABSTRACT

An apparatus for handling sheets of paper has a depositing/dispensing unit for depositing papers put into the apparatus by an operator and for dispensing papers to an operator. Within the apparatus there is a counter unit, a storage box unit and a transporting unit that includes a robot hand for transporting papers between the units. A space is formed within the counter unit between a separating unit and a stacking unit within which the depositing/dispensing unit can move. Also, the space enables maintenance tasks to be performed easily by providing access to the components of the counter unit. The apparatus is capable of handling two kinds of paper in both depositing and dispensing transactions. The counter unit provided with locked covers that prevent access to spaces where paper to be deposited can be stored.

59 Claims, 10 Drawing Sheets

APPARATUS FOR HANDLING SHEETS OF PAPER

The present application is copending with U.S. application Ser. No. 874,131, filed June 13, 1986, now U.S. Pat. No. 4,884,698 entitled "Apparatus For Handling Sheets Of Paper" and having the inventors H. Tutamune et al.

BACKGROUND OF THE INVENTION

1. Field of the Invention

The present invention relates to an apparatus for handling sheets of paper that include a depositing/dispensing unit or port for allowing a customer to deposit sheets of paper into the machine or receive sheets of paper from the machine. Internally, the machine has a counter unit, a sheets of paper handling mechanism, a storage box or cash cassette, an inspecting unit and a transporting unit for transporting the sheets of paper between these units and the depositing/dispensing unit.

The machine is capable of handling two types of paper sheets and has a storage box or cash cassette that can be preloaded, securely locked, and placed in the machine for loading the machine with sheets of paper.

The counter unit of the machine has sensors for detecting the sheets of paper, and a method and apparatus for cleaning the sensors when their output drops from being blotted by dust or other matter.

2. DESCRIPTION OF RELATED ART

An automatic transacting machine is disclosed in Japanese Laid-Open No. 61-291370. The disclosed machine has a depositing/dispensing unit or port for the sheets of paper, an inspection unit, a storage box, and a transporting unit for transporting the sheets of paper between these units.

In operation, the disclosed machine handles a dispensing transaction by having the transporting unit put a predetermined number of sheets of paper into a hopper of the inspection unit. Thereafter, the inspection unit counts the sheets of paper to provide a number of sheets that corresponds to the amount of the request being made an operator in the transaction. Then, the sheets of paper are transferred from the inspection unit to the depositing/dispensing unit by the transporting unit. On the other hand, for a depositing transaction, the transporting unit transfers the sheets of paper received from the depositing/dispensing unit to the hopper of the inspection unit whereupon the sheets of paper are inspected and counted. Afterward, the counted sheets of paper are sent to a predetermined position in the storage box by the transporting unit.

The operation of the above disclosed machine in the dispensing transaction is relatively slow, because the sheets of paper must first be removed from the storage box and placed into the hopper of the inspection unit, before they are counted and transferred to the depositing/dispensing unit for delivery to the operator. The step of removing a predetermined number of sheets of paper for each dispensing transaction from the storage box is folloWed by, after the counting step, returning the excess sheets that were not dispensed in the transaction to the storage box. Accordingly, the sheets of paper are removed from and replaced in the storage box for the dispensing transactions.

Within the storage box of the known machine, compartments are provided for storing the sheets of paper to be used in the dispensing transactions, and for storing the sheets of paper that are rejected by the inspection unit. These compartments are fixed and located within the machine in fixed predetermined locations. The size of each compartment must be adequate for storing the sheets of paper to be dispensed, the rejected sheets of paper, and the sheets of paper deposited in a depositing transaction. Accordingly, the objective of minimizing the size of the storage box is constrained by having to provide an adequate size for each of the fixed compartments within the storage box.

As for the machine disclosed above, there is a further problem wherein little consideration has been taken into account for eliminating both the jamming of the counter unit of the machine and for obtaining easy access to the various components of the machine for conducting proper maintenance. For the above machine, it is necessary to use a special tool to correct for any jamming problems that occur within the counter. At times, it is necessary to also open the counter, but this requires opening the transporting unit also. Therefore, it is difficult to obtain easy access to the components of the above-disclosed machine, and to clear the counter when jamming occurs.

In the above-identified machine, sensors are provided for detecting the existence of the sheets of paper at several stacked sections located adjacent the counting unit. The detecting ability of these sensors drops, however, as the result of being blotted by dust or the like. Accordingly, the operation of the sensors becomes faulty or fails and maintenance must be performed to clean the sensors and restore them to proper operation.

SUMMARY OF THE INVENTION

It is an object of the present invention to shorten the time required to complete a transaction with the customer. It is a further object of the invention to shorten the access time for the dispensing transactions.

Another object of the present invention is to provide a papers handling system that shortens the transaction time by evacuating the papers in the inspection unit hopper to a space, large enough to receive all of the papers, in the storage box that is created temporarily. Thus, providing an additional fixed compartment space for the temporary evacuation of the paper in the inspection unit hopper is unnecessary, and the storage box can be reduced in size.

It is an object of the invention to provide a storage box for a papers handling system having movable shelving so that the size of the compartments or spaces within the storage box can be changed and their relative position with respect to the transporting unit adjusted. The storage box is provided with movable shelves to define at least first and second spaces. A drive control is provided for moving the storage shelves to change the sizes of the first and second spaces. By this arrangement, the machine is capable of handling two kinds of sheets of paper.

It is a further object to provide an inspection unit for a paper handling system having a first hopper for holding papers of one kind and a second hopper for holding papers of another kind, the second hopper being temporarily evacuated to receive the papers being deposited in a depositing transaction. Therefore, the objective of shortening the dispensing transaction time is achieved by providing first and second hoppers in the inspection unit that are stacked with sheets of paper ready to be dispensed to an operator. Further, the papers of the other kind in the second hopper can be temporarily evacuated therefrom by the transporting unit and stored in the first space of the storage box. The sheets of paper in the second hopper are removed altogether for temporarily evacuating the second hopper only when a depositing transaction is intended to be carried out. In a dispensing transaction, Wherein the inspection unit hoppers are stacked with paper currency, it is sufficient for the inspection unit to inspect and count out the needed number of sheets of paper directly from the first and second hoppers in order to meet the operator's request. Thereafter, the transporting unit transfers the papers thus inspected and counted to the dispensing-/depositing unit for the operator's access.

In the case of a depositing transaction, the transporting unit returns the papers in the second hopper altogether to the first space of the storage box, which is created by shifting the shelving within the storage space, to evacuate them from the second hopper temporarily. As a result, the storage box size can be minimized.

It is a further object of the invention to provide an apparatus for handling sheets of paper having a storage box having shelving that is movable such that the space between a lower storage shelf and the papers in the second space can be widened by moving the storage shelf so that the conveyor robot can transfer the papers. Thus, it is unnecessary to provide a separate space for the conveyor robot within the second space and therefore the total storage capacity of the storage box is retained and the limited space of the storage box used most efficiently.

It is an object of the invention to provide an apparatus for handling sheets of paper that can solve the problems of the prior art related to the difficulty in clearing the jamming of the counter unit and the difficulty in maintaining and inspecting the various components of the machine. In accordance with this objective, a space is formed in one region of a sheets of paper handling unit for allowing the transfer of sheets of paper between a depositing/dispensing unit and a counting unit. Further, the present invention achieves this objective by providing a depositing/dispensing unit that is movable between at least a first position wherein the transfer of sheets of paper with an operator is accomplished, and a second position located in the formed space for accomplishing the transfer of the paper to the sheets of paper handling mechanism. To clear jamming of the sheets of paper handling unit or the counter, the depositing/dispensing unit is moved from the second position to the first position. Further, the components of the machine may be easily maintained or inspected as a result of providing the formed space that the depositing/dispensing unit moves in and out of in the aforementioned second and first positions respectively.

It is an object of the invention to provide an apparatus for handling sheets of paper having a counter unit that includes a separator unit and a stacking unit and a conveyor unit that extends between the separator unit and stacking unit for conveying or transferring sheets of paper that have been separated in the separator unit to stackers in the stacking unit. The conveyor unit may be provided separately and function only to convey sheets of paper between the separator and stacking units, or the sheets of paper may be conveyed between the separator and stacker units by the transporting unit of the invention, which also handles the transporting of sheets of paper between the counter unit, storage box unit and depositing and dispensing unit. Accordingly, a variety of positions of the stacker unit relative to the separator unit can be achieved wherein the stacker unit is above or below the separator unit with the conveyor unit extending between the ends of the stacker and separator units, or the stacker and separator units may be offset with respect to one another so that the conveyor unit extends between one end of the stacker unit, for example, and the corresponding opposite end of the separator unit. In the arrangement wherein the stacker and separator units are offset with respect to one another, the transporting unit of the apparatus can move between the corresponding opposite ends of the stacker and separator units to convey sheets of paper between the two units in place of the conveyor unit.

It is another object of the invention to provide an apparatus for handling sheets of paper wherein the machine has a separator or inspection unit and a hopper for the separator unit that can be preloaded and thereafter placed into the machine, such that the prevention of theft of the sheets of paper so preloaded is prevented. Accordingly, to achieve the objectives of the invention, the separator unit has a control unit covered with a keyed cover. Therefore, when the sheets of paper are preloaded in the separator unit of the counter, the keyed cover preVents unauthorized access to the sheets of paper, and the separator unit can thereafter be placed into the machine. It is another object of the invention to provide a separator or inspection unit that can be preloaded with sheets of paper so that the speed of the dispensing transaction can be increased by eliminating the need to remove paper from a storage box, deliver it to the inspection unit for the dispensing of a certain amount of the sheets of paper that has been removed, and returning the excess sheets of paper that were removed from the storage box to initiate the dispensing transaction. Accordingly, sheets of paper counting and dispensing operations can be accomplished at high speed.

It is a further object of the invention to provide an apparatus for handling sheets of paper having a plurality of sensors for detecting the existence of the sheets of paper as they are transported between various predetermined locations, and a sensor cleaning apparatus that is able to detect an output of the sensors and to clean the sensors whose output drops because of dust or dirt build-up on the surface of the sensor. In the prior art, sensors are provided for detecting the existence of sheets of paper, but no apparatus has been disclosed for detecting When the sensors' output drops and for cleaning a sensor whose output drops as a result of the build-up of dust or dirt on the surface of the sensor.

It is an object of the invention to provide a sensor cleaning device that keeps the operating reliability of the sensors at a high level whenever the output of the sensors drops, as detected by the sensor cleaning device. To achieve this objective, a control unit is provided for feeding a test signal to the sensors and for receiving a response signal from the sensors, responsive to the test signal. A cleaning signal is generated when the response signal indicates a drop in the output of the sensors, and a cleaning device responds to the cleaning signal by cleaning the sensor which is identified as having a drop in output.

BRIEF DESCRIPTION OF THE DRAWINGS

FIG. 12 is a view showing the relation between a robot hand of the transporting unit and a shutter when sheets of paper are taken in;

DETAILED DESCRIPTION OF THE PREFERRED EMBODIMENTS

Figure 1:
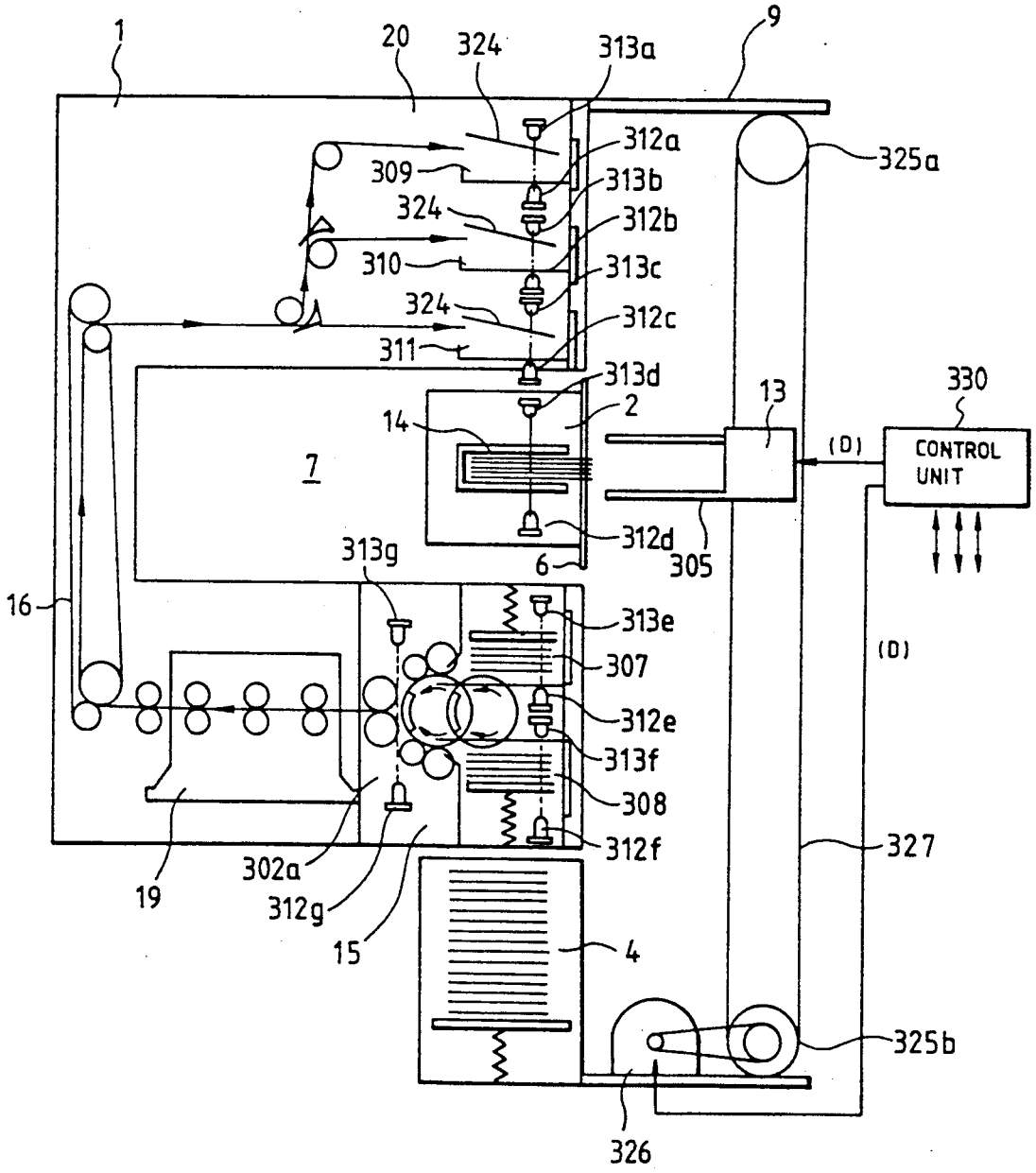
FIG. 1 is a side elevation showing an embodiment of the apparatus for handling sheets of paper of the present invention having a sensor output detecting and cleaning system.
Figure 2:
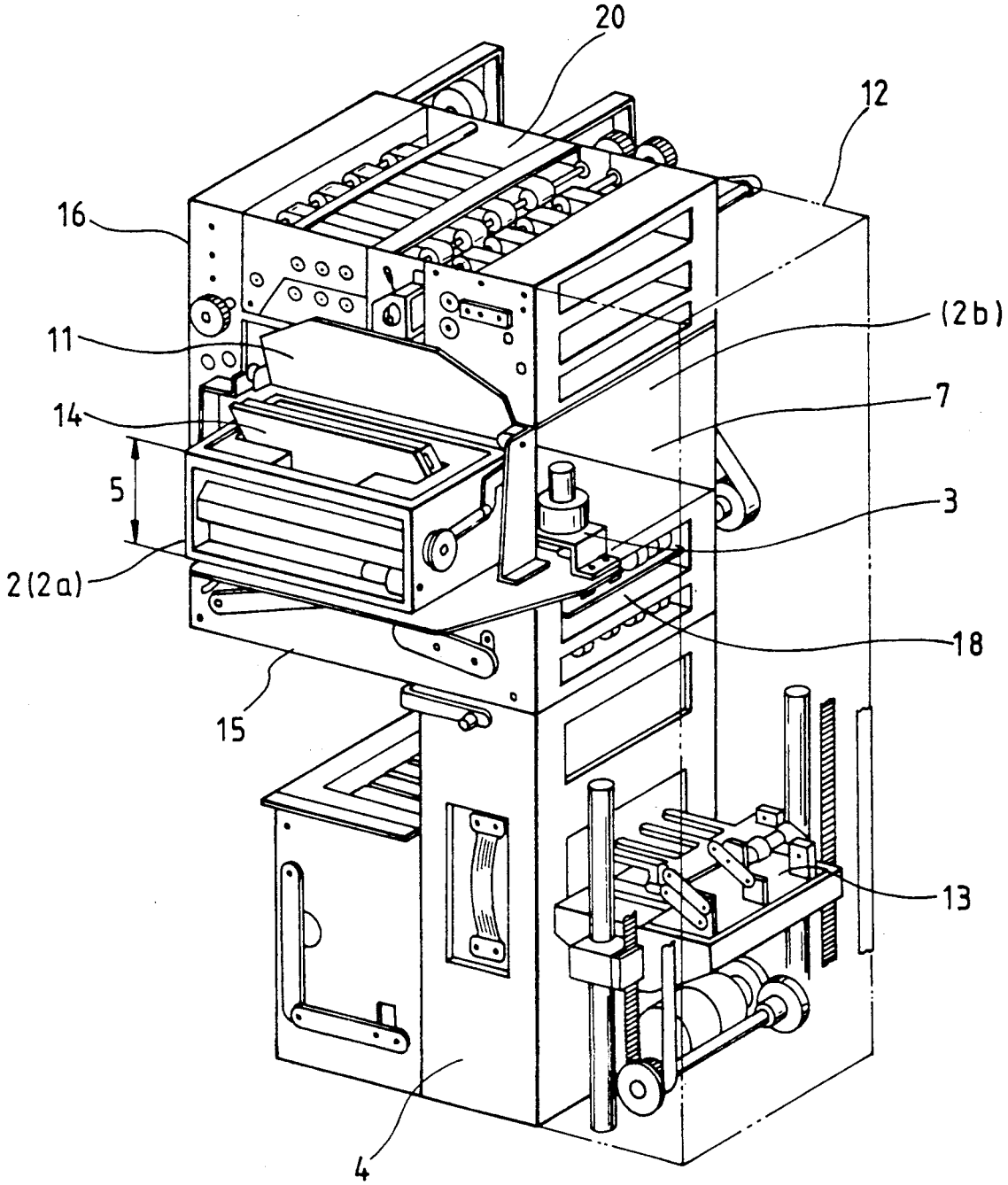
FIG. 2 is a perspective view of the sheets of paper handling apparatus.

An apparatus for handling sheets of paper machine constructed according to an embodiment of the present invention is shown in FIGS. 1 and 2. It is equipped with a depositing/dispensing unit 2 having a cover 11, a counter unit 1 for counting sheets of paper 14, a storage box 4, and a hand 13 having fingers 305. Reference numeral 3 designates a turning portion of the depositing/dispensing unit 2.

The counter unit 1 is equipped, as shown in FIGS. 1 and 2, with a separator unit 15 having a hopper unit 18, a discriminator unit 19, a conveyor unit 16, and a stacker unit 20 having a stacker unit 17. It is also provided with a space 7 created by properly arranging the separator unit 15, the conveyor unit 16, the stacker unit 20 and so on. This space 7 can be used for transfer of the sheets of paper 14 between the counter unit 1 and the depositing/dispensing unit 2 and for maintenance and inspection of the machine.

The depositing/dispensing unit 2 is mounted to move on a pivot pin 6 of turning portion 3 from a first position 2*a*, to a second position 2*b* and further through the turning portion 3 to a third position 2*c*.

In the above-specified first position 2*a*, the paper is transferred between the depositing/dispensing unit 2 and the user. The above-specified second position 2*b* is one which is defined in the counter portion 1 for the transfer of the paper currency between the counter unit 1 and the depositing/dispensing unit 2. In the above-specified third position 2*c*, the space 7 is opened for maintenance and inspection of the machine.

To operate the apparatus, the user puts into or takes out the sheets of paper 14 in accordance with the opening or closing of a cover 11 of the receipt/delivery unit 2.

Figure 3:
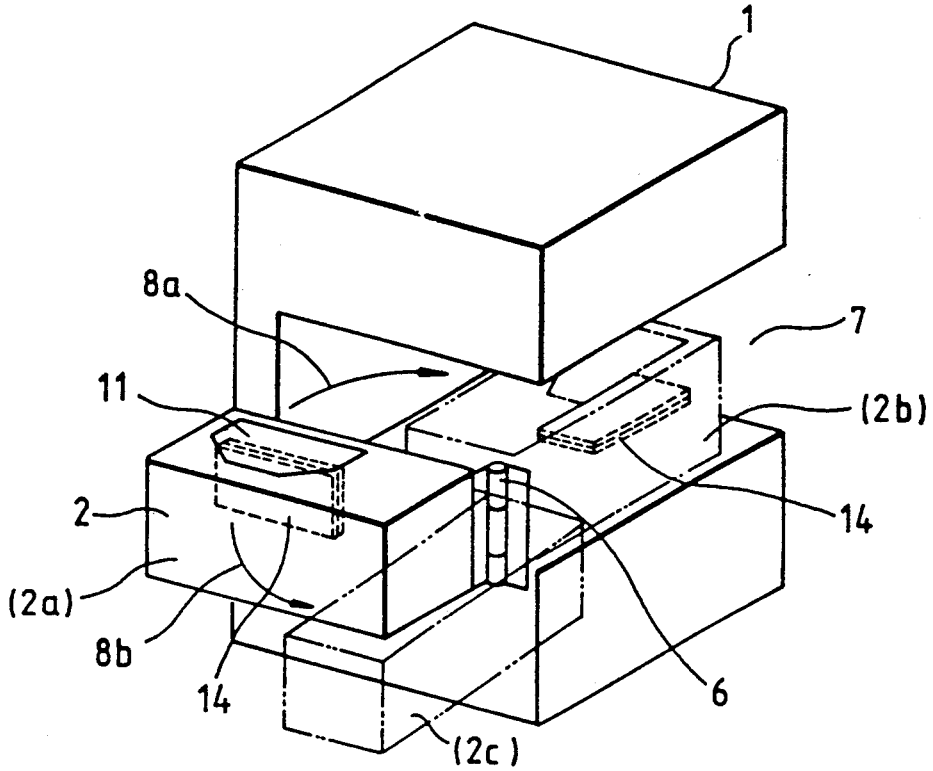
FIG. 3 is a perspective view showing a counter unit and a depositing/dispensing unit of the sheets of paper handling apparatus.

The counter unit 1 of the apparatus is provided wit a space 7, into which is introduced the depositing/dispensing unit 2 by turning it 90 degrees on the pivot pin 6 in the direction of arrow 8*a*, as indicated in FIG. 3, When the paper 14 is to be counted.

The paper 14 is transferred by the hand 13 among the depositing/dispensing unit 2, the counter unit 1 and the storage box 4. When the sheets of paper are to be deposited, the cover 11 of the depositing/dispensing unit 2 is opened, and the user puts the sheets of paper 14 into the depositing/dispensing unit 2. After the cover 11 of the depositing/dispensing unit 2 has been closed, this unit 2 is turned 90 degrees on the turning portion 3 from the first position 2*a* to the second position 2*b* inside the space 7. Here, the papers 14 are turned 90 degrees from a vertical position to a horizontal position in the depositing/dispensing unit 2. Then, the paper 14 is transferred by the hand 13 to the hopper unit 18 in the separator portion 15 of the counter portion 1 so that it may be separated and counted.

The sheets of paper 14 thus separated and counted by the separator unit 15 are conveyed by the conveyor unit 16 and stacked by the stacker unit into one of three stackers 309–311. Thereafter, it is transported to the storage box 4 by the hand 13.

When the sheets of paper are to be dispensed, the sheets of paper 14 are taken out from the storage box 4 by the hand 13 and are handed to the hopper unit 18 in the separator unit 15 of the counter unit 1. Hopper unit 18 has upper and lower hoppers 307 and 308 respectively. For dispensing, single sheets of the paper 14 are separated from the stack of sheets within the hoppers by a group of large and small rollers 302 that rotate in the direction of the arrows shown. The separated sheets are conveyed through discriminator 19 for counting and stacked in stacker unit 20. The sheets of paper are then transferred by the hand 13 to the depositing/dispensing unit 2 waiting in the space 7 of the counter unit 1. Here, the depositing/dispensing unit 2 is turned 90 degrees on turning portion 3 in the direction opposite to the arrow 8*a* of FIG. 3 so that it is moved from the second position 2*b* to the first position 2*a*. Then, the paper 14 is turned 90 degrees in the depositing/dispensing unit 2 from the horizontal position to the vertical position. Thereafter, the cover 11 of the depositing/dispensing unit 2 is opened so that the user can receive the sheets of paper 14.

Next, the construction of the counter unit 1 will be described in detail with reference to FIG. 4.

The counter unit 1 stores the sheets of paper 14 in the hopper unit 18 of the separator unit 15 and separates it into separate sheets. The counter unit 1 counts the number of those sheets through the discriminator unit 19 and hands them to the conveyor unit 16. The conveyor unit 16 conveys the paper currency 14 separated and counted to the stacker unit 20. The stacker unit 20 stacks the paper currency 14 received from the conveyor unit 16 in one each of the stackers 309–311 depending upon the result of the discrimination in discriminator unit 19.

Figure 4:
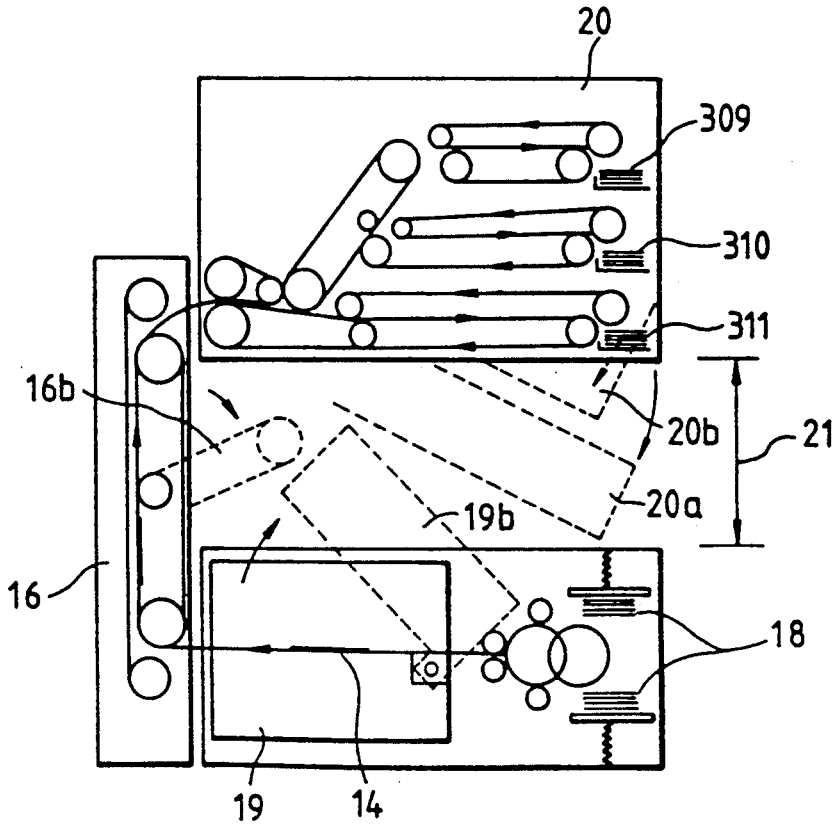
FIG. 4 is a side elevation showing a counter unit of the apparatus that shows alternate positions of some of the components of the apparatus.

FIG. 4 shows the flow of the sheets of paper 14 in counter unit 1. The size 21 of the space 7 can be freely set so as to correspond to the size 5 of the depositing/-dispensing unit 2 shown in FIG. 2. Moreover, the size 21 of the space 7 can be set at an arbitrary size necessary for eliminating the jamming of the paper-currency handling mechanism 12 with the paper currency 14. On the other hand, the construction of the counter unit 1 can be modified by changing the combination of the separator unit 15, the conveyor unit 16 and the stacker unit 20.

The operations of eliminating the jamming with the paper currency and maintaining and inspecting the machine are described with reference to FIG. 3. In case the counter unit 1 gets jammed with paper 14, the attendant moves the depositing/dispensing unit 2 from the second position 2*b* to the first position 2*a* to retract it from the space 7. In order to facilitate the elimination of the jamming, moreover, the attendant turns the depositing/dispensing unit 2 in the direction of the arrow 8*b* of FIG. 4 to the third position 2*c*.

Further, referring to FIG. 4, jamming of the paper in the discriminator unit 19 is eliminated by opening a hatch 19*b* into the space 7. The jamming of the conveyor unit 16 with the paper 14 is eliminated by opening a belt/roller unit 16*b* through the space 7. Similarly, the jamming of the stacker unit 20 with the paper 14 is eliminated by opening belt/roller units 20*a* and 20*b* through the space 7.

Since the hatches of the individual portions forming the counter unit 1 are constructed to be opened into the space 7, as has been described hereinbefore, the maintenance tasks can be simplified. Moreover, when the counter unit 1 is arranged, as shown in FIG. 1, the jamming can be visually inspected and eliminated without taking out the counter unit 1 from the automatic cash transacting machine 9.

The advantages enumerated above can also be applied to the maintenance and inspection of the machine, and the sensors and belts can be easily replaced.

Figure 5A:
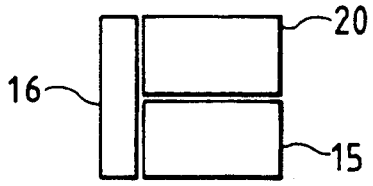
FIGS. 5(*a*) to 5(*d*) are schematic diagrams showing various arrangements of the units of the apparatus.
Figure 5C:
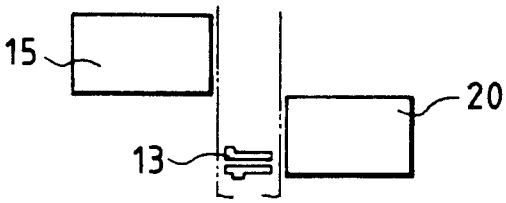
Figure 5B:
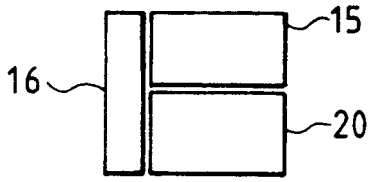
Figure 5D:
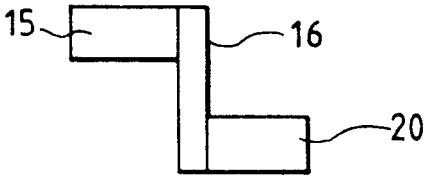

FIGS. 5*a* to 5*d* are schematic diagrams showing modifications of the arrangement of the components of the counter unit. FIG. 5*a* shows an example, in which the space 7 is shortened, and the counter unit 1 may be fixed. FIG. 5*b* shows an example, in which the positions of the separator unit 15 and the stacker unit 20 are inverted from those shown in FIG. 5*a*. FIG. 5*c* shows an example, in which the transfer between the separator unit 15 and the stacker unit 20 is accomplished by the hand 13 in place of the conveyor unit 16. FIG. 5*d* shows an example, in which the separator unit 15 and the stacker unit 20 are arranged symmetrically at 90 degrees with respect to the center of the conveyor unit 16.

According to the embodiments of FIGS. 5*a* to 5*d*, the individual portions of the counter unit 1 can be freely selected and arbitrarily combined in accordance with the functions, mounting space and price of the machine.

According to the embodiments of the present invention, a space is formed in one region of the apparatus that allows room for transferring paper with the hand of the transporting unit and for separating, conveying and counting the paper. Further, the depositing/dispensing unit is made movable between at least the first position for transactions with the user and the second position located in the space for transferring the paper to the counter unit with the transporting unit. For eliminating jamming of the paper and maintaining and inspecting the machine, the depositing/dispensing unit is retracted from the space formed in the one region of the counter unit so that those operations may be accomplished by making use of that space. As a result, elimination of jamming of the paper and the maintenance and inspection of the machine can be easily accomplished, and the structure can be simplified to provide the machine at a reasonable cost.

Figure 9:
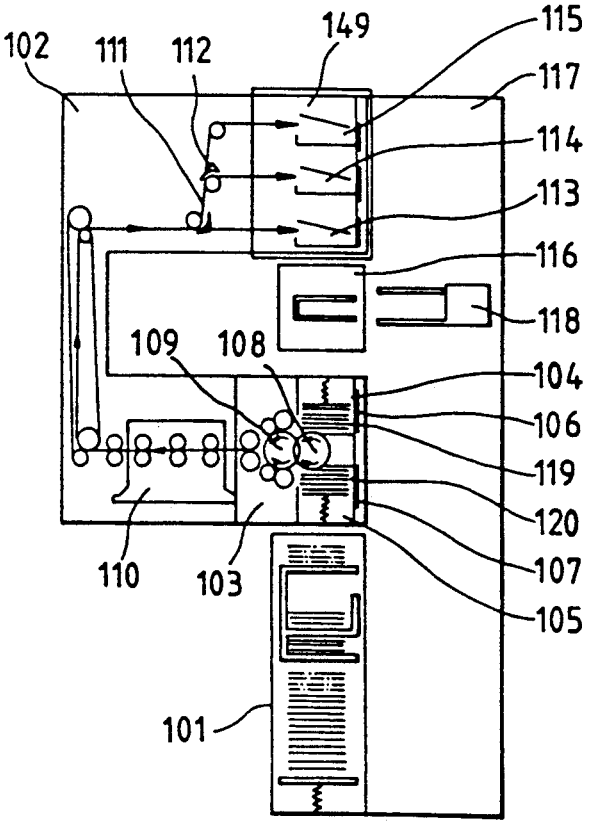

FIG. 9 shows another embodiment of an apparatus of the invention in which two kinds of sheets of paper are to be handled. The apparatus is constructed of a paper storage unit 101; a counter unit 102 having a paper separator unit 103; paper stackers 113 to 115; a paper depositing/dispensing unit 116; and a paper transporting unit having a hand 118. The paper storage unit 101 stores two kinds 119 and 120 of paper currency in a separate manner. The counter 102 is equipped with the separator unit 103, a discriminator 110 and gates 111 and 112.

The separator unit 103 of the counter 102 has hoppers 104 and 105 and a pair of rollers 108 and 109. The hoppers 104 and 105 are loaded in advance with a supply of sheets of paper 119 and 120 from the storage unit 101. Normally closed shutters 106 and 107 are attached to the hoppers 104 and 105. The rollers 108 and 109 are adapted to separate a necessary number of sheets of paper 119 in the hopper 104 one by one, when rotationally driven in the counter clockwise direction, and a necessary number of sheets of paper 120 in the hopper 105 one by one when rotationally driven in the clockwise direction as viewed in FIG. 9.

The discriminator unit 110 determines which kind of paper 119 and 120 is fed out from the separator unit 103 to the output of discriminator control gates 111 and 112. Gates 111 and 112, therefore, sort and store the two kinds of paper 119 and 120 in the stackers 113 and 114 in accordance with the discriminated results. The conveyor mechanism unit 117 is constructed to transfer the paper 119 and 120 in individual portions With the hand 118. Hand 118 of the transporting unit 117 is used in advance to load the paper currency 119 of the paper-currency storage unit 101 in the hopper 104 of the separator unit 103 and the paper currency 120 in the hopper 105 of the same separator unit 103.

In the dispensing operation, rollers 108 and 109 of the separator unit 103 are first rotated in the counter clockwise direction to separate a necessary number of sheets of paper 119 one by one from the hopper 104 so that the sheets of paper 119 may be counted. Then, the rollers 108 and 109 are rotated in the opposite direction to separate a necessary number of sheets of paper 120 one by one from the hopper 105 so that the sheets of paper 120 may be counted. Then, the counted number of paper sheets 119 and 120 thus separated from the hoppers 104 and 105 are stored in the stacker 115. Next, the sheets of paper 119 and 120 are transferred from the stacker 115 to the depositing/dispensing unit 116 by the hand 118 and delivered to the customer.

In the depositing operation, paper received through the depositing/dispensing unit 116 from the customer is grasped by the hand 118 and set in the hopper 105 of the separator unit 103. From there, the papers are returned to storage unit 101 by the following operation. Rollers 108 and 109 of the separator unit 103 are rotated in the clockwise direction to separate and convey the received paper currency of the hopper 105 sheet by sheet to the discriminator unit 110. The separated sheets of paper are discriminated one by one, and the gates 111 and 112 are switched in accordance with the determined kind of paper (119 or 120) so that the paper 119 is stored in the stacker 113 whereas the paper 120 is sorted and stored in the other stacker 114. After this, the sheets of paper 119 and 120 once returned to their storage unit 101 are set again in the hoppers 104 and 105 by the hand 118.

According to the embodiment shown in FIG. 9, therefore, in the dispensing operation, the necessary amount of paper sheets 119 and 120 loaded in advance in the hoppers 104 and 105 of the separator unit 104 may be separated and counted, but no excess paper need be returned. The paper depositing and dispensing operations may be accomplished only in case the sheets of paper 119 and 120 in the hoppers 104 and 105 become short. Thus, the paper counting and dispensing operations can be promptly accomplished.

Figure 6:
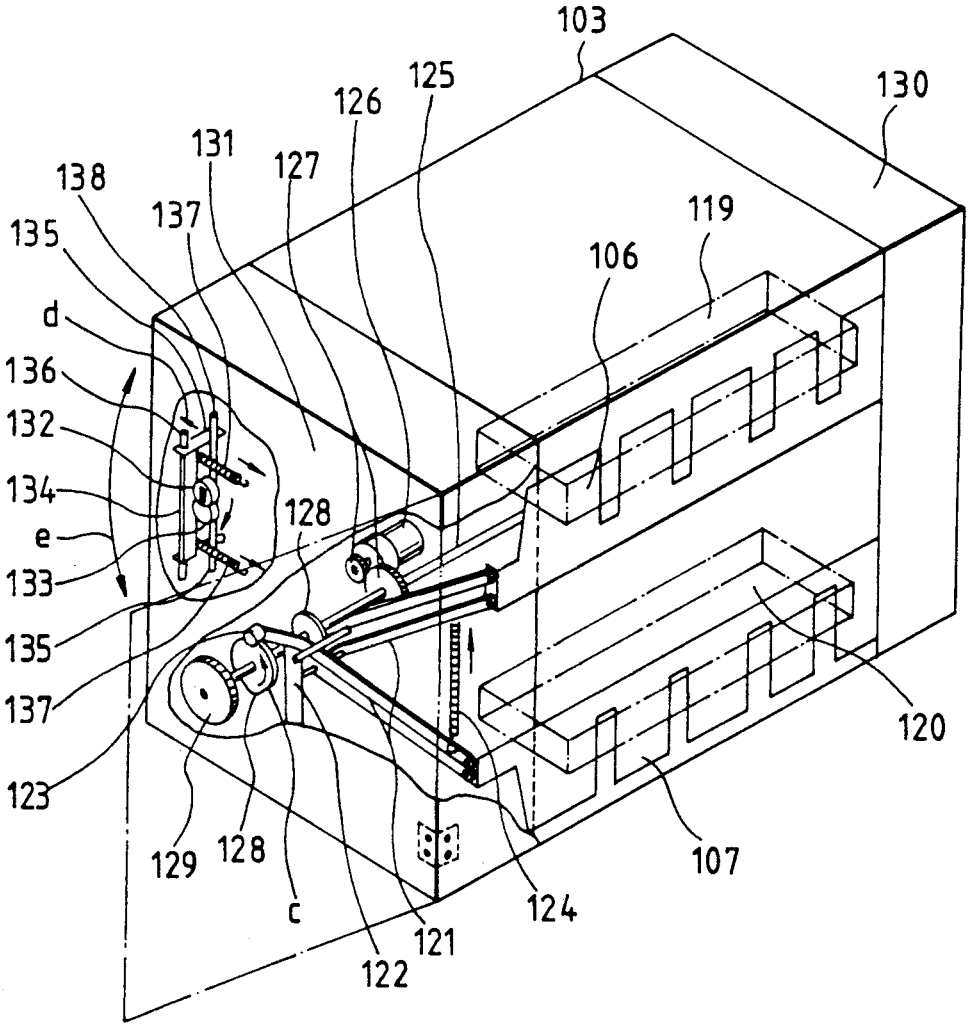
FIG. 6 is a perspective view showing details of the separator unit of the apparatus.

FIG. 6 is a perspective view, partially in section, showing the detail of the separator unit of the counter. The separator unit 103 has its hoppers 104 and 105 loaded with the paper 119 and 120, respectively. Shutters 106 and 107 are attached to openings in the hoppers, and are connected to opening and closing control mechanisms.

Furthermore, the separator unit 103 has two sides covered with covers 130 and 131. Of these covers, cover 131 of the separator unit 103 located at the side of the control unit is keyed at 132 so that it can be opened only by the attendant.

The shutter control mechanism is constructed of: a parallel link 121 connected to both shutters 106 and 107, respectively; a pivot pin 125; a motor 126; two cams 128 mounted on the pivot pin 125; and a knob 129 attached to the pivot pin 125.

The parallel link 121 has one end portion pinned to the shutters 106 and 107, an intermediate portion equipped with a fulcrum 122, and the other end portion equipped with a cam follower 123 that engages with a cam 128. On the other hand, parallel link 121 is energized by a tension spring 124 to rotate at all times in a direction to close the shutters 106 and 107. Pivot pin 125 is connected through a gear train 127 to the motor 126 so that it may be driven. Cam 128 is mounted on the pivot pin 125 to open or close the shutters 106 and 107 through the cam follower 123 and the parallel link 121. Knob 129 can be operated, only when the cover 131 of the control unit is opened, to allow the shutters 106 and 107 to be manually opened or closed.

In the shutter opening/closing mechanism of the embodiment shown in FIG. 6, the cam follower 123 mounted on the other end portion of the parallel link 121 is fitted on the root of the cam 128, except when the paper currency is to be put into or taken out from the hoppers 104 and 105 of the separator unit 103, and the cam follower 123 itself is held on the root of the cam 128 by the action of the tension spring 124. As a result, the shutters 106 and 107 are kept closed.

When paper currency is to be put into or taken out from hoppers 104 and 105, motor 126 is energized by a control signal received so that its driving force is transmitted through the gear train 127 to rotate the pivot pin 125. As this pivot pin 125 rotates, cam 128 is turned in the direction of arrow c, as shown in FIG. 6, so that the cam follower 123 is pushed by the crest of the cam 128. As a result, the parallel link 121 is turned against the action of the tensile spring 124 to open the shutters 106 and 107.

Thus, even if the hoppers 104 and 105 of the separator unit 103 are loaded in advance with the paper, the shutters are kept closed while the paper is transferred, so long as the motor 126 is driven by the control signal. This makes it possible to store the sheets of paper safely in the hoppers 104 and 105.

The aforementioned cover 131 covering the control unit of the separator unit 103 is equipped with the key lock 132 and the latch mechanism.

The key lock 132 is made integral with a cam 133. This cam 133 is used to unlock a latch mechanism. The latch mechanism is constructed of a latch plate 134 and a latch bar 138 fixed to the body side of the separator unit 103.

The latch plate 134 is supported to rotate on a fulcrum 136. Moreover, the latch plate 134 is formed with two latch pawls 135 which are spaced from each other. The latch pawls 135 can be retained on and off the aforementioned latch bar 138. The latch plate 134 is energized by a a tension spring 137 to rotate in a direction to catch the latch bar 138. Latch pawls 135 are retained on the latch bar 138 through the latch plate 134 by the action of the tension spring 137. Therefore, cover 131 cannot be opened, normally.

When trouble arises, the attendant inserts the key into the key hole and turns it and accordingly the latch plate 134 in the direction of arrow d through the cam 133 against the action of the tension spring 137. Then, the latch pawls 135 of the latch plate 134 are disengaged from the latch bar 138 so that the cover 131 of the separator unit 103 at the side of the control unit can be opened in the direction of arrow e. Thus by conveniently opening cover 131 when a problem arises, the control unit of the separator unit 103 ca be inspected and easily maintained. Moreover, because cover 131 cannot be opened by any person other than the attendant carrying the key, the paper can be safely stored in the hoppers 104 and 105 of the separator unit 103.

Figure 7:
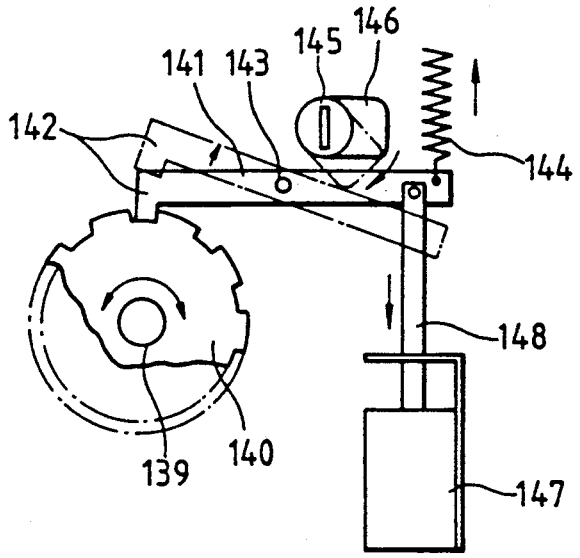
FIG. 7 is a front elevation showing an embodiment of a latch mechanism of an another embodiment of that shown in FIG. 6.

FIG. 7 is a front elevation showing another embodiment of the latch mechanism which is disposed at the side of the control unit of the separator unit. The latch mechanism is provided with: a latch cam 140 mounted on a drive shaft 139; a latch plate 141 having a latch pawl 142; a key lock 145 having a cam 146; and a solenoid 147 for disengaging the latch pawl 142. The drive shaft 139 is connected to a motor (although not shown). The latch cam 140 is provided With latching recesses which are circumferentially spaced from one another.

The latch plate 141 is so supported as to accomplish a lever motor through a fulcrum 143. The latch plate 141 is provided at its one end portion with the latch pawl 142, which is adapted to engage with one of the latching recesses formed in the latch cam 140. The other end portion of the latch plate 141 retains a tension spring 144, by which the latch plate 141 is energized to engage with the latch recesses of the latch cam 140. Key lock 145 is adapted to push the latch plate 141 through the cam 146 out of engagement with the latching recesses of the latch cam 140. Further, solenoid 147 is constructed to pull the latch plate 141 through a rod 148 so that the latch pawl 142 is draWn out of engagement with the latching recesses of the latch cam 140.

In the latch mechanism shown in FIG. 7, the latch plate 141 is energized in the normal state such that the latch pawl 142 engages with the latching recesses. Thus, the shutters (as shown in FIGS. 1 and 2) of the hoppers of the separator unit cannot be opened unless the latch is disengaged.

If the shutters are to be opened, the latch plate 141 is pushed by the cam 146 of the key lock 145 in a direction for the latch pawl 142 to come out of engagement with the latching recesses of the latch cam 140. Alternatively, the solenoid 147 is energized to pull the latch plate 141 through the rod 148 in a direction for the latch pawl 142 to come out of engagement from the latching recesses of the latch cam 140. In either case, the latch is disengaged, and the motor is driven to open the shutters of the hoppers of the separator unit.

Figure 8:
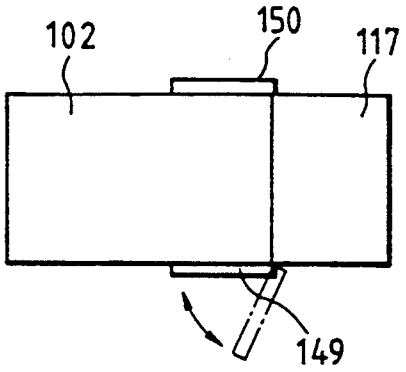
FIGS. 8 and 9 are a top plan view showing another embodiment of the apparatus of the invention, and a side elevation showing the components of the apparatus, respectively.

FIG. 8 is a top plan view showing another embodiment of the present invention. The portion of the machine having stackers 113 to 115 has both of its sides covered with covers 149 and 150. At least one of these covers is keyed and can be opened if unlocked by the key (although not shown). According to this embodiment, therefore, a maintenance task can be performed easily when trouble arises, merely by opening at least one cover 149. Since, moreover, the openable cover 149 can be provided with a keyed latch such that the stackers 113, 114 and 115 can be used to store the sheets of paper safely.

Figure 10:
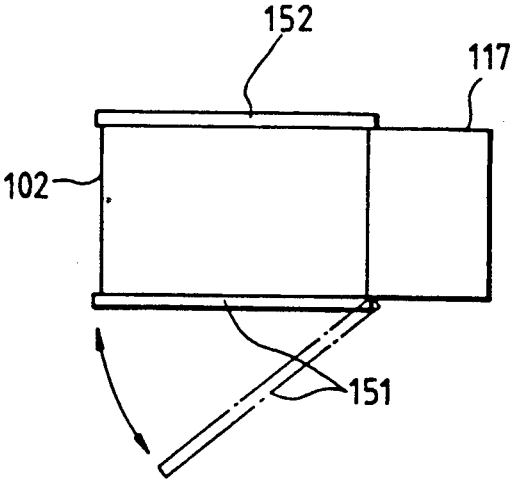
FIG. 10 is a top plan view of another embodiment of the apparatus of the present invention.

FIG. 10 is a top plan vieW showing still another embodiment of the present invention. In this embodiment, the whole counter 102 has both of its sides covered with covers 151 and 152. At least one of these covers is keyed and can be opened if unlocked by the key (although not shown).

According to the embodiments of the present invention shown in FIGS. 6–10, the hoppers of the separator unit in the counter are loaded in advance with sheets of paper from the storage unit. Thus, when the paper sheets are to be counted and dispensed, it is sufficient to separate and count only a necessary number of sheets of paper loaded in the hoppers of the separator unit, but it is not necessary to return the excess paper to the storage unit. As a result, there can be attained an effect that the paper can be promptly counted and dispensed. Moreover, the control unit of the separator unit of the counter is covered with the keyed covers. Thus, the paper cannot be taken out from the outside, even if it is set in the hoppers of the separator unit, to provide another effect that the crime prevention can be improved. Further, when the separator unit is faulty, the attendant can unlock the keyed covers so that he can inspect and maintain the machine easily.

Figure 11:
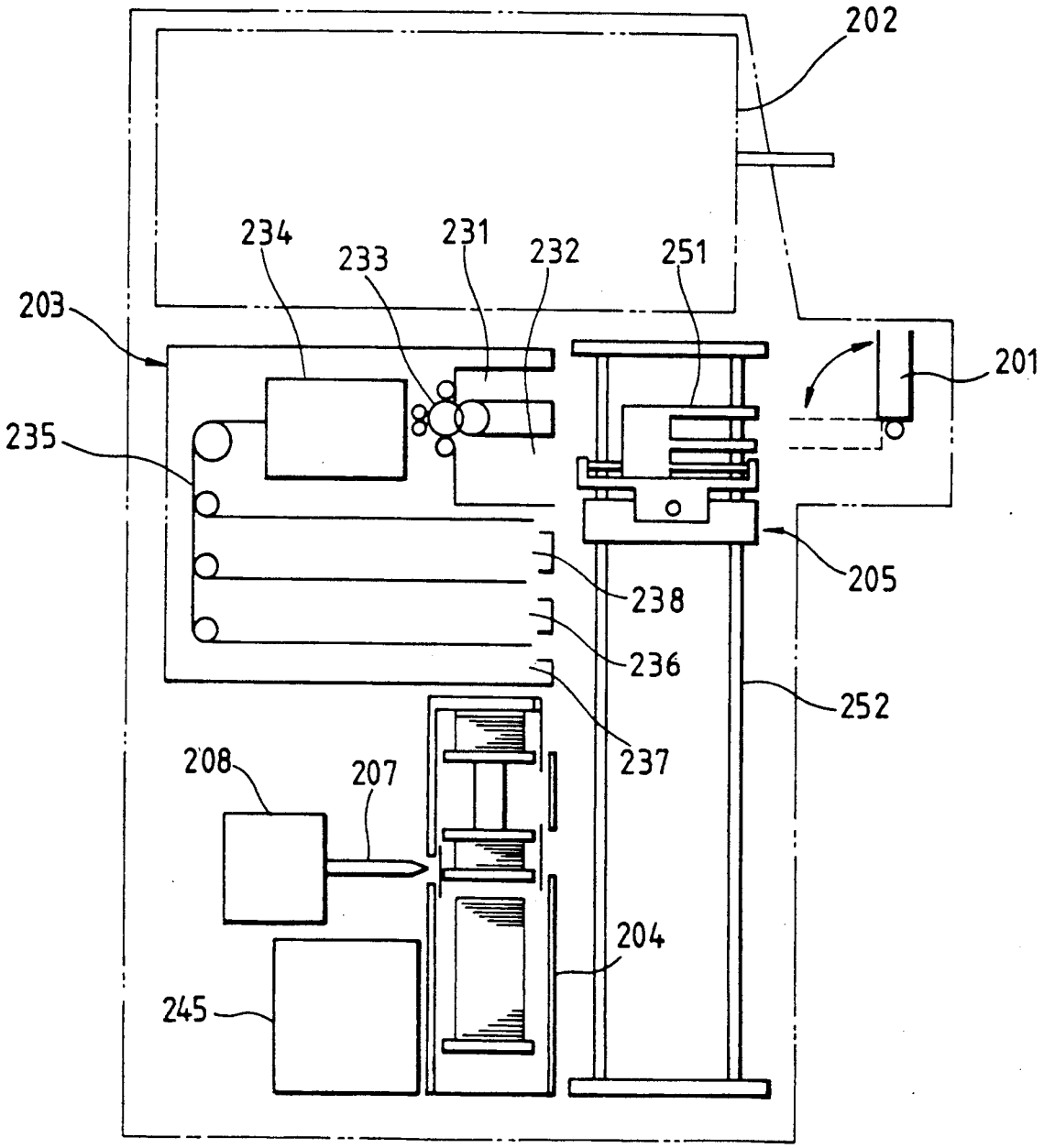
FIG. 11 is a side elevation view showing another embodiment of the apparatus of the invention.
Figure 12:
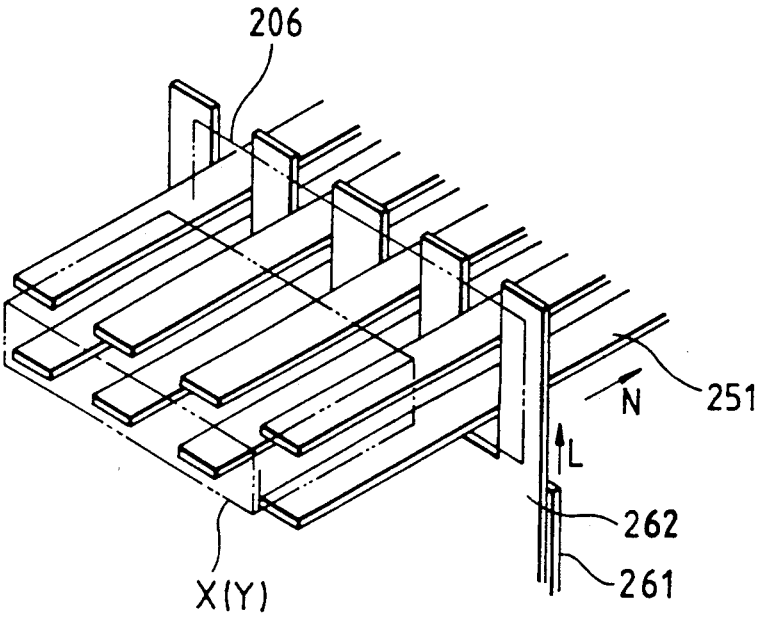

The present invention will be further described in connection with another embodiment of an apparatus for handling sheets of paper of two different kinds with reference to FIGS. 11–13. As shown in FIG. 11, the apparatus of this embodiment has a depositing/dispensing unit 201, a transaction slip issuer 202, a counting and inspection unit 203, a storage box 204 and a robot hand 205.

The depositing/dispensing unit 201 is adapted to receive sheets of paper thereinto during a depositing transaction and to dispense the paper therefrom when in a paying transaction. Unit 201 is formed in a box shape having one open side. It can be turned in the directions of the arrows shown in FIG. 11.

The slip issuer 202 imprints slips with the contents of the transaction or the like and issues them to the customer following a transaction.

The counting and inspection unit 203 is disposed below the slip issuer 202, facing unit 201, and has a separator 233. The separator is equipped with first and second hoppers 231 and 232 for receiving sheets of paper of different kinds. The first hopper 231 is for receiving paper of a first kind Y, for example 10,000 yen notes and the second hopper 232 is for receiving paper of a second kind X, for example 1,000 yen notes. Moreover, the second hopper 232 takes the paper deposited, too, when in the depositing transactions.

Unit 203 is constructed of: a separator 233 interposed between the first and second hoppers 231 and 232 for selectively separating and delivering the sheets of paper taken into the first and second hoppers 231 and 232, respectively; a discriminator 234; stackers 236 and 237 for stacking the two kinds of paper Y and X, respectively; a conveyor belt 235; and a stacker 238 for receiving and stacking the paper rejected.

The storage box 204 is disposed below the inspection unit 203 and is used not only for storing in advance the paper Y and X to be used for the transactions, but also for storing the paper of the X kind or another kind, for example 5,000 yen notes that have been deposited and also for the unusable and counterfeit sheets of paper deposited.

The conveyor robot 205 conveys and transfers the paper currencies among depositing/dispensing unit 201, counting and inspection unit 203 and storage box 204. The conveyor robot has a pair of hands 25 each having four fingers for receiving the paper currencies; a guide 252 for supporting the hands 251 in a vertically movable manner and arranged in the vertical direction between the unit 203 and 201, and between unit 203 and the front of the storage box 204. The conveyor robot also has a drive unit (although not shown) for the hands 251.

The hands 251 are moved, in a dispensing transaction, along the guides 252 to predetermined positions of the storage box 204 by the drive unit to grip and receive a plurality of sheets of the paper in the storage box 204. After this, the hands 251 move to the inspection unit 203 to transfer the paper to the first and second hoppers 231 and 232 of the inspection unit 203. The paper counted by the inspection unit 203 is received by the stackers 236 and 237 and is moved and transferred to the depositing/dispensing unit 201. During a depositing transaction, on the other hand, the hands 251 are moved to the depositing/dispensing unit by the drive unit to receive the paper deposited by the user. The hands 251 move to deliver the paper to the second hopper 232. After this, the deposited paper sorted by the inspection unit 205 are gripped by the stackers 236 and 237 and moved to the storage box 204 so that they are stored in the storage box 204.

Figure 13:
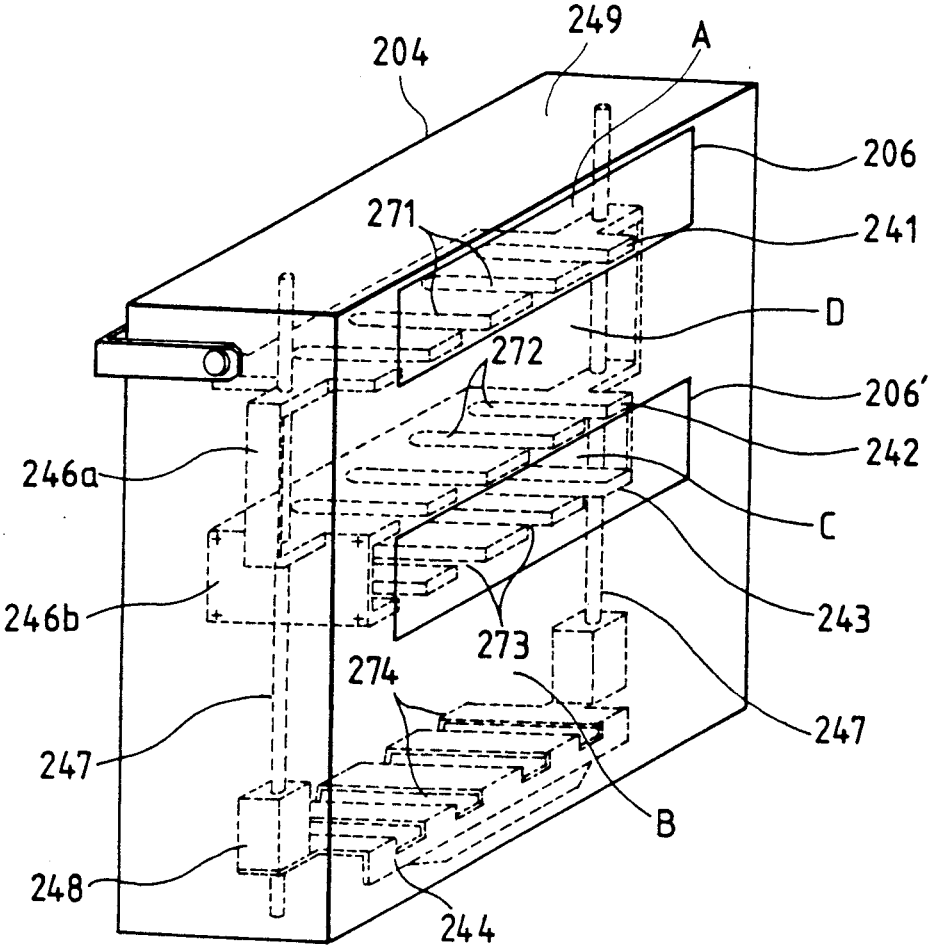
FIG. 13 is a perspective view of a storage box of an apparatus for handling sheets of paper of the present invention.
Figure 15:
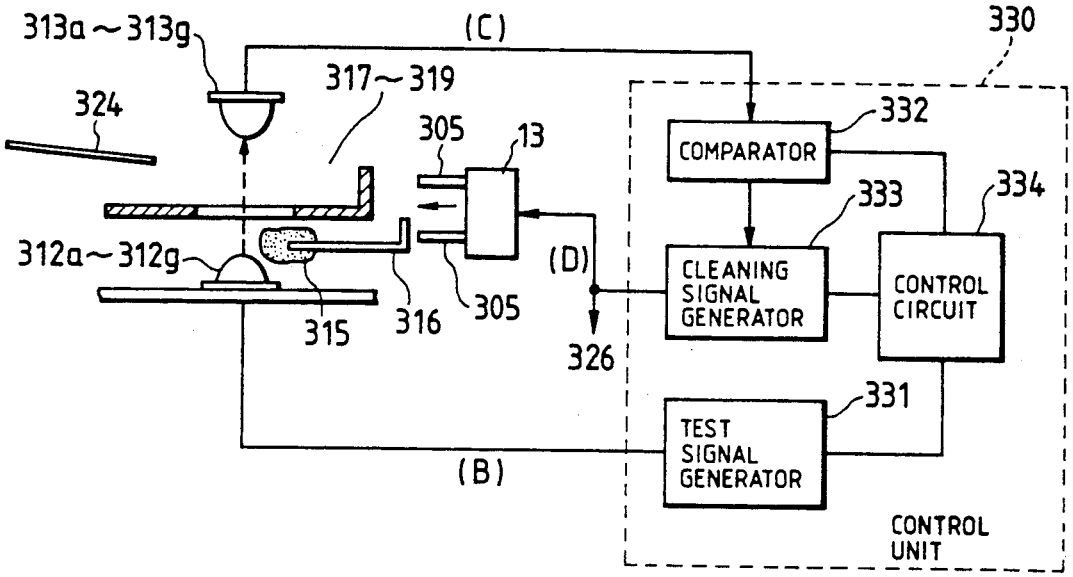
FIG. 15 is a diagram showing an essential portion of the same.

The storage box 204, as shown in FIG. 13, has a plurality of storage shelves 241 to 243, a push plate 244 and a drive control unit 245. The storage shelves 241 to 243 are divided into the upper one 241, the middle one 242 and the lower one 243. The shelves are united at predetermined spacings in the vertical direction of the storage box 204 by means of first and second connecting plates **246*a* and 246*b*. Of these, the first connecting plate 246*a* connects one end of upper storage shelf 241 with one end of the second connecting plate 246*b*, which in turn connects one end each of the middle and lower storage shelves 242 and 243** together.

Moreover, first connecting plate **246*a* has apertures, sleeves, or the like for receiving a slide post 247 that is disposed upright in the storage box 204. As a result, storage shelves 241 to 243 are supported to move together in the vertical direction within the storage box 204**.

The push plate 244 has arms 248 at each end, which receive slide post 247. The push plate 244 is positioned in the storage box 204 below the lower storage shelf 243 and moves in the vertical direction independently of the shelves, if desired.

As an example, sheets of paper can be stored in box 204 as follows: 300 sheets of paper X are stored in advance in a first space A between the upper storage shelf 241 and the top board 249 and in a third space C between the middle and lower storage shelves 242 and 243, respectively; and 1,200 sheets of paper Y are stored in advance in a second space B between the lower storage shelf 243 and the push plate 244. The first and third spaces A and C are sized for the robot hand 205 to be able to deposit or remove the sheets of paper X altogether. A fourth space D between the upper and lower storage shelves 241 and 242 is provided for storing rejected papers and papers of the X kind or another kind not of the Y kind.

Drive control unit 245 moves the storage shelves 241 to 243 and the push plate 244 selectively in accordance with a program to change the sizes of the first and second spaces A and B relative to each other. For example, the drive control unit 245 is constructed of: a moving mechanism (not shown) for moving the storage shelves 241 to 243 and the push plate 244 in the vertical direction; and a control for controlling the moving mechanism.

When the storage box 204 having the sheets of paper loaded therein is placed in the system, the conveyor robot 205 removes the paper of kind X in one stack from the first space A between the upper storage shelf 241 and the top plate 249 of the storage box 204 and conveys the stack to the inspection unit to transfer the same to the second hopper 232. Moreover, the conveyor robot 205 receives a suitable number (about 100 to 150 sheets) of paper currency Y from the second space B between the lower storage shelf 243 and the push plate 244 and moves it to the first hopper 231 of the inspection unit 203.

In order for the conveyor robot 205 to remove the paper currency from the storage box 204, as shown in FIG. 13, the storage shelves 241 to 243, and the push plate 244 have notches 271–273, and 274 respectively for alloWing entrance of the fingers of the hands 251 appropriately above and below the papers stacked in the space being entered depending on whether the papers are being set in or taken out of the storage box.

As shown in FIG. 13, upper and lower shuttered openings 206 and 206' are formed in positions to normally face the first and third spaces A and C in storage box 204 respectively. Openings 206 and 206' are each equipped, as shown in FIG. 12, with a first shutter 261, and a second comb-shaped shutter 262 arranged inside of the first shutter 261. A drive source (although not shown) is provided for driving the first and second shutters 261 and 262. The first and second shutters 261 and 262 are opened by the drive source to allow the conveyor robot 205 to enter the storage box 204 when taking out or depositing sheets of paper. Incidentally, the second shutter 262 is moved in an intersecting direction between the fingers of the hand 251 of the conveyor robot 205, as indicated by an arrow L in FIG. 12. When the hands 251 are retracted in the direction of arrow N, the second shutter 262 pushes the stack of papers off of the retracting fingers to thus deposit the stack to a desired position of the storage box 204.

In the storage box 204, the spacing between the paper sheets in the second space B and the lower storage shelf 243 can be widened so that the hands 251 of the conveyor robot 205 may enter to remove or deposit the sheets of paper. In this case, the storage shelves 241 to 243 are lifted by the drive control unit 245 to a position not shown when the conveyor robot 205 transfers the paper currencies to the second space B. In order that the conveyor robot 205 may easily remove sheets of paper from the second space B, a dividing pawl 207 divides the upper portion of sheets of paper of the stack in the second space B from the lower portion of sheets of paper. The dividing pawl 207 is equipped, as shown in FIG. 11, with a drive source 208 for moving it back and forth with respect to the storage box 204. When the storage shelves 241 to 243 are lifted so that the conveyor robot 205 may receive the paper of the second space B, the dividing pawl 207 is moved forward into the storage box 204 by the drive source 208 so that it enters the stack of paper Y of the second space B through an opening 209. Preferably, 100 to 150 sheets of the upper portion of the paper stack in space B is divided from the lower portion. Thus, the hands 251 of the conveyor robot 205 can remove the upper portion of the paper Y from the space B. For this purpose, the dividing pawl 207 moves forward from a position about 15 mm downward from the lower shelf 243.

Moreover, the storage box 204 is so constructed that the conveyor robot 205 transfers the sheets of paper X (of 1,000 yen nots, for example) of the second hopper 232 altogether to the first space A of the storage box for depositing transactions.

Figure 18:
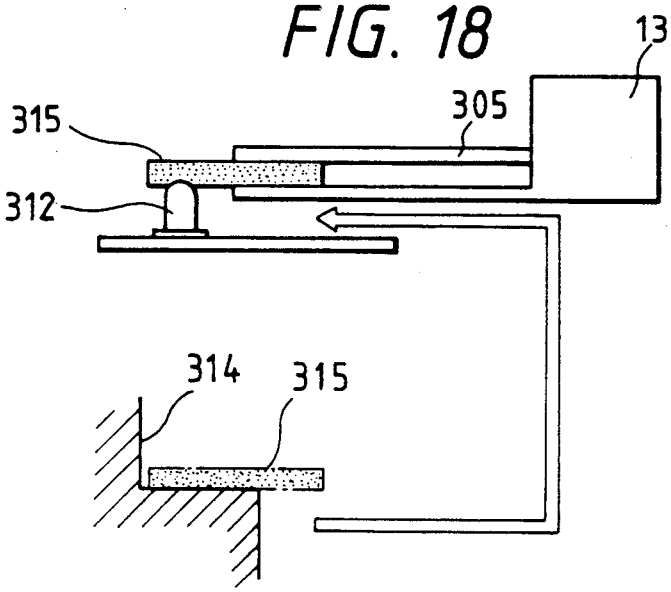
FIG. 18 is a diagram showing a second sensor cleaning embodiment.

In a depositing transaction, conveyor robot 205 receives sheets of paper of kind X from the second hopper 232 and moves them to storage box 204 through opening 206 to the first space A between the top plate 249 and the upper storage shelf 241 of the storage box 204. Storage shelves 241 to 243 are driven to move them downward to a home position as shown in FIGS. 13 and 18 during a depositing transaction.

In preparation for operation of the apparatus, the attendant stores the sheets of paper in the predetermined spaces of the storage box 204. Papers of kind X are loaded into the first space A between the top plate 249 and the upper storage shelf 241, and also into the third space C between the middle and lower storage shelves 242 and 243. Papers of kind Y are stored in the second space B between the lower storage shelf 243 and the push plate 244.

After this, the preparations for the dispensing transactions are accomplished by setting the storage box 204 thus stored with the papers X and Y in the system. Specifically, the conveyor robot 205 removes paper of kind X altogether from the first space A of the storage box 204, retracts in the direction of arrow M, and then deposits the removed paper in second hopper 232. After this, conveyor robot 205 removes a suitable number of sheets of paper of kind Y from the second space B of the storage box 204 and conveys them to the first hopper 231. When, in this case, the conveyor robot 205 removes the paper currency Y from the second space B, its hands 251 can enter space B only if storage shelves 241 to 243 are driven upward to positions not shown. The storage shelves 241 to 243 are driven upward to widen the spacing between the lower storage shelf 243 and the paper of kind Y in the second space B so that the upper storage shelf 241 may come into abutment against the top plate 249 of the storage box 204. At the same time, the dividing pawl 207 moves in the direction of arrow M to divide the paper of kind Y so that the paper of kind Y in space B may be removed.

For a dispensing transaction, the amount of sheets to be dispensed is first designated by an operator or user. The inspection unit 203 then counts the number of sheets of the paper required in order to match the designated amount. Thereafter, the conveyor robot 205 conveys the counted paper to the depositing/dispensing unit 201 so that the dispensing transaction can be accomplished.

For a depositing transaction, the storage shelves 241 to 243 are moved down by the drive control unit 245 to return them to the initial position (FIG. 11). The conveyor robot 205 then transfers the paper of kind X from the second hopper 232 to the first space A in order to evacuate hopper 232 prior to accepting the deposited sheets of paper. In other words, the paper of kind X can be evacuated from the second hopper 232 and transferred to the first space A (created by the downward movement of the storage shelves 241 to 243 if the apparatus was previously in a dispensing mode of operation). Thereafter conveyor robot 205 transfers the deposited paper from the depositing/dispensing unit 201 to the second hopper 232, whereupon the deposited paper can be inspected and counted by the counting and inspection unit 203 and conveyed to stackers 236 and 237. If, moreover, the conveyor robot 205 transfers again the paper of kind X of the first space A to the second hopper 232, in preparation for a dispensing operation, the X paper and that of another kind not Y is stacked on the stacker 237 to be transported to the fourth space D of the storage box by the conveyor robot 205. On the other hand, the paper of kind Y is stacked on the stacker 236 and thereafter transferred and dropped into the second space B by the conveyor robot 205.

In each case, after the conveyor robot transfers the paper of kind X of the first space A to the second hopper 232, the storage shelves 241 to 243 are driven upward to widen the space B so that the stack of paper of kind Y may be penetrated by the dividing pawl and removed by the hands 251 of the conveyor robot 205. It may also be necessary to drive push plate 244 upward. Further, in case all of the paper of kind X in the second hopper 232 is used up in the dispensing transactions, a supply of paper can be removed from the third space C between the middle and lower shelves 242 and 243 and transported to the second hopper 232 by the conveyor robot 205.

As has been described above, the conveyor robot 205 transfers the paper of kind X of the first space A in the storage box 204 to the second hopper 232 of the inspection unit 203 and the paper of kind Y of the second space B to the first hopper 231. To accomplish a dispensing transaction, therefore, it is only necessary that the conveyor robot 205 transfer the designated amount of paper currency to the depositing/dispensing unit, which amount is properly counted out by counting and inspection unit 203. Accordingly, the access time required for dispensing the paper is reduced.

For the depositing transactions, on the other hand, conveyor robot 205 merely returns paper of kind X in the second hopper 232 altogether to the first space A so that it is temporarily evacuated from the second hopper 232. This operation prevents the size of the storage box 204 from having to be enlarged, while making it further unnecessary to provide another space for the paper thus evacuated. Moreover, when the paper of kind X is transferred altogether to the second hopper 232 from space A, the spacing between the lower storage shelf 243 and the paper in the second space B can be widened to ensure adequate room for the correct transfer of the paper currency. This makes it unnecessary to provide another opening for admitting the conveyor robot 205 into space B, and allows the paper of kind Y to be stored in advance throughout the height of the second space B. As a result, the limited space of the storage box can be effectively used while preventing the total storage capacity from being reduced.

Access to the sheets of paper in storage box 204 is obtained by moving the storage shelves 241 to 243 and the push plate 244 in the same directions. If the number of sheets of paper of kind Y stored in the second space B decreases, positions of not only the conveyor robot 205 but also the dividing pawl 207 in relation to the stack of currency Y can be maintained constant by raising the push plate 244 and the stack of paper supported thereon. Thus an advantage is attained in simplifying the controls for operating the conveyor robot 205 and the dividing pawl 207.

Another modification of a storage box for the apparatus of the invention is contemplated wherein the first and second spaces A and C of the storage box 204 are stored with paper of kind Y so that only paper of kind Y can be transacted. In this embodiment, for the dispensing preparations, the conveyor robot 205 transfers in advance the paper of kind Y of the first space A of the storage box 204 to the second hopper 232 of the inspection unit 203. If the paper of kind Y in the second hopper 232 is used for the dispensing transaction, then storage shelves 241 to 243 and the push plate 244 of the storage box 204 are lifted so that the conveyor robot 205 transfers the paper of kind Y of the second space B to the first hopper 231 of the inspection unit 203 thereby to use the paper of kind y in the first hopper 231 for the dispensing transaction. If the paper of kind Y in the first hopper 231 is all used up, then paper of kind Y in the second space B is sequentially transferred by suitable numbers of sheets to the first hopper 231.

With reference again to FIG. 1, the individual components of the apparatus of the invention handling the sheets of paper, such as the stackers 309, 310 and 311, the hoppers 307 and 308 of the separator unit 302 or the depositing/dispensing unit 306 are equipped with light receiving sides 313*a* to 313*g* and light emitting sides 312*a* to 312*g* of optical sensors. These sensors may be blotted with dust (more frequently at the lower levels) as time elapses so that the existence of the paper currency may possibly not be detected as a result of the dust build-up.

Accordingly, as shown in FIG. 1, a system for checking the operation of the sensors is shown. In FIGS. 14–21, details of the system are shown.

The robot hand 13, as shoWn in FIG. 1, is fixed to one portion of a belt 327, which is made to run on pulleys 325*a* and 325*b*, and is moved up and down by the drive of a motor 326. Reference numeral 330 designates a control unit for controlling the operations of the motor 326 and robot hand 13. In a test mode, the control unit 330 feeds a test signal to the light emitting side sensors 312*a* to 312*g* and receives a response signal from the light receiving side sensors 313*a* to 313*g*. A more detailed description will be made with reference to FIG. 15. The control unit 330 includes: a signal generator 331 for feeding a test signal B to the light emitting side sensors; a comparator 332 for receiving the response signal from the light receiving side sensors in response to the feed of the test signal to judge the state of the response signal; a cleaning signal generator 333 responding to the judgment signal from the comparator 332 for generating a cleaning signal when the response signal indicates a drop in the detecting ability of the sensors; and a control circuit 334 for controlling the operations of the above-specified components 331 to 333.

When the response sign (C) received indicates a drop in the sensor's detecting ability, the control unit 330 generates the cleaning signal (D) from its cleaning signal generator 333 in response to the judgment signal from the comparator 332 and feeds it to the robot hand 13 and the motor 326.

Figure 16:
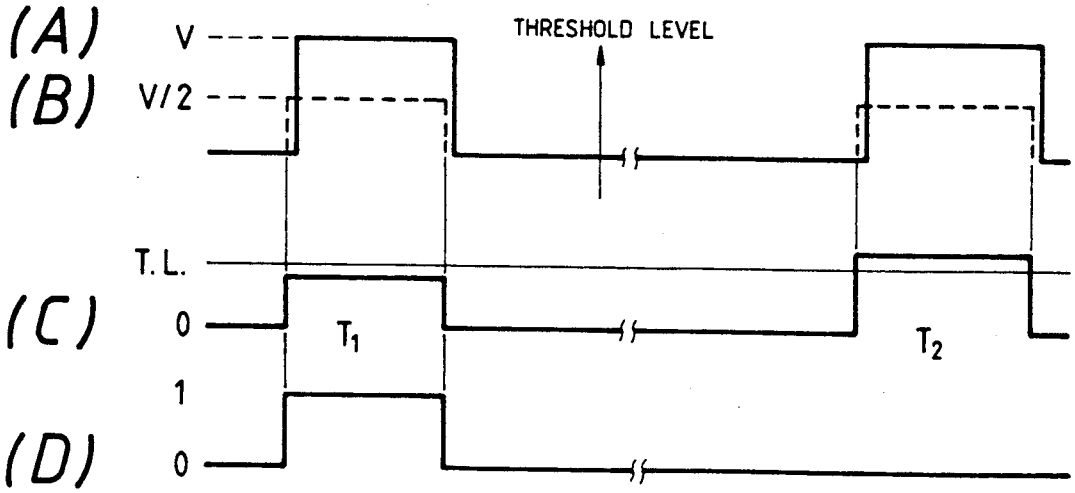
FIG. 16 is a waveform chart showing the signals of the same.
Figure 21:
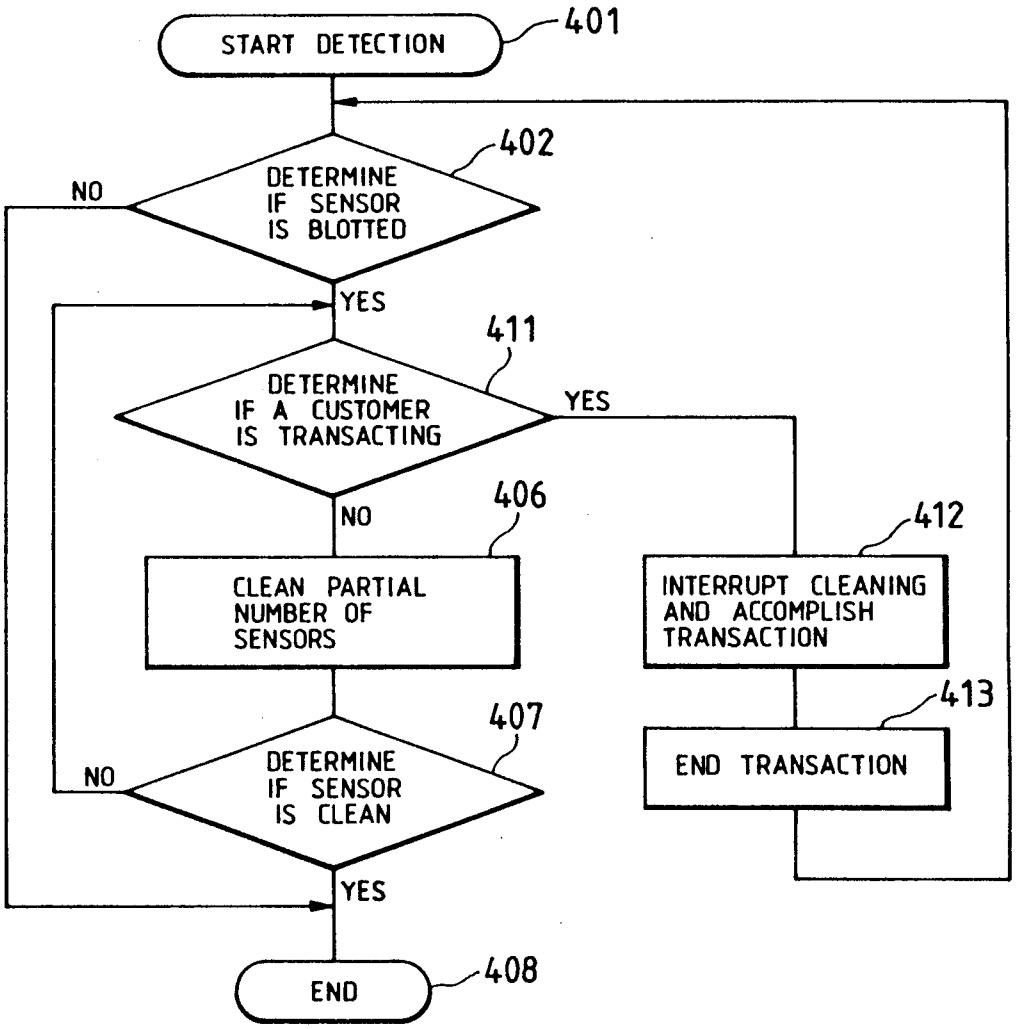
FIG. 21 is a flow chart showing the operations of a fifth sensor cleaning embodiment.

These individual signals (A) to (D) are generated with waveforms at predetermined times, as illustrated in FIG. 16. The signal (A) is a sensor drive signal generated in a normal operation mode and has an amplitude of a predetermined level V. In the test mode of the sensors, the test signal (B) is generated (as is illustrated by broken lines shifted more or less in timing so that it may be discriminated from the signal (A)). The test signal has a half amplitude of V/2 (i.e., half light check) of the sensor driven signal. The signal (C) is returned form the sensors in response to the test signal (B). The comparator 332 judges whether or not that signal is over the threshold level (i.e., T.L.) in the normal operation. If NO (at a timing $T_1$ of FIG. 16), the comparator 332 feeds a signal indicating this result to the circuit 333. If YES (at a timing $T_2$ of FIG. 16), the comparator 332 generates no signal. Incidentally, in case none of the sensors has a drop in output, it is assumed that a response signal equal to or higher than T.L. has been generated even for the amplitude of V/2.

If the sensors are functionally faulty and generate a response signal lower than T.L., the cleaning sign (D) is generated from the circuit 333. Then, in response to this signal (D), the motor 326 moves the robot hand 304 to the corresponding sensor, and the robot hand 13 (having a finger driving motor built therein) moves backward in the direction indicated by the arrow shown in FIG. 15, to bring a cleaning member (made of an elastic material such as sponge) through a lever 316 into sliding contact with the faulty one of the sensors 312*a* to 312*g*. Incidentally, lever 316 is spring biased in the direction opposed to the arrow of the hand 304 in a conventional manner by a spring not shown.

Figure 14:
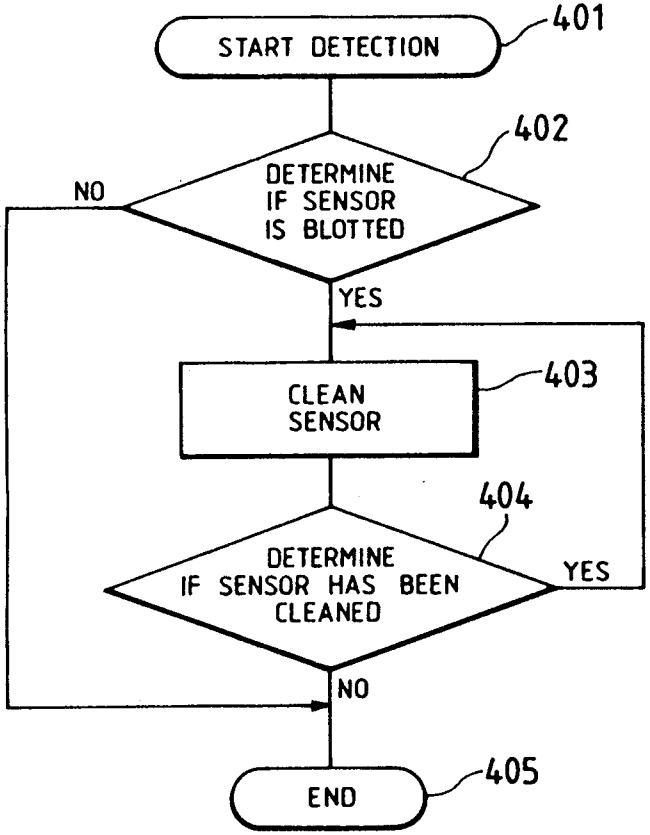
FIG. 14 is a flow chart showing the sensor cleaning operations.

FIG. 14 is a floW chart showing the aforementioned cleaning operations. First of all, at a step 401, test signal (B) is generated at a specified interval such that the light emitting side sensor 312 has an intensity half as high as the normal one. Next, at a step 402, whether or not the sensor is blotted with dust is detected in accordance with the response signal (C) from the light receiving side sensor 313. The answer is YES, if the signal (C) is lower than T.L., and NO if higher. If YES, the corresponding sensor at the light emitting side is cleaned at a step 403 in response to the signal (D). These specific operations are carried out, as has been described hereinbefore, by driving the robot hand and the motor. After the cleaning operation, whether or not the blot has been cleaned off is checked again at a step 404 with the half light. If YES, the routine is returned to the step 103 to accomplish again the cleaning operation thereby to clear the dust away.

Figure 17:
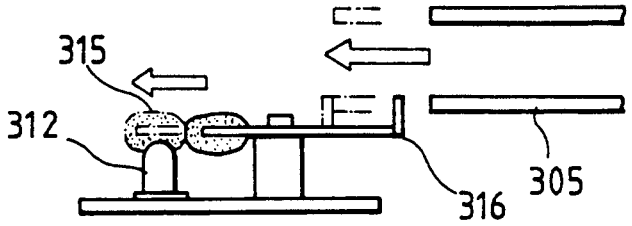
FIG. 17 is a diagram showing a first sensor cleaning embodiment.

The specific elements used in the cleaning operation are described with reference to FIGS. 17 to 20. FIG. 17 illustrates the cleaning method wherein the lever 316 is pushed with the fingers 305 of the hand, as described hereinbefore. The lever 316 having the cleaning member 315 is arranged in the vicinity of the light emitting side sensor 312 and is pushed by the fingers 305 so that the cleaning member 315 rubs to clean the surface of the sensor 312. Accordingly, the cleaning operation is sufficiently accomplished merely by mounting a lever that does not require any drive source adjacent each of the sensors.

FIG. 18 shows another embodiment, in which cleaning member 315 is gripped with fingers 305 of hand 13 from a specified position 314 of the apparatus to bring the cleaning member 315 into sliding contact with the sensor 312. According to this embodiment, the cleaning operation can be accomplished merely by providing the cleaning member without the need for any additional mechanisms so that the number of parts is reduced to a minimum and the reliability of the cleaning operation is enhanced.

Figure 19:
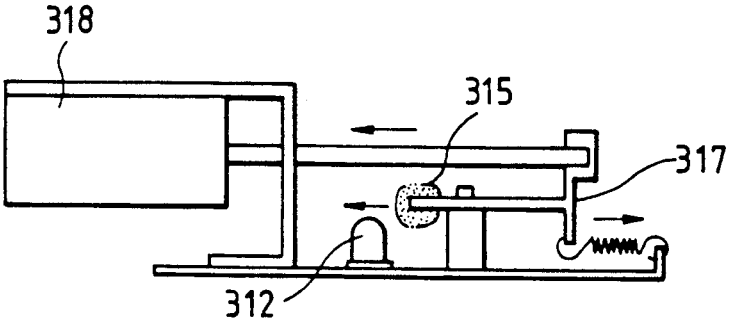
FIG. 19 is a diagram showing a third sensor cleaning embodiment.

FIG. 19 shows a further embodiment, in which the sensor 312 is cleaned by moving the lever 317 in response to the signal (D) by an actuator 318 on the apparatus. According to this embodiment, the sensor can be cleaned even it is so positioned as to otherwise be inaccessible by the hand.

Figure 20:
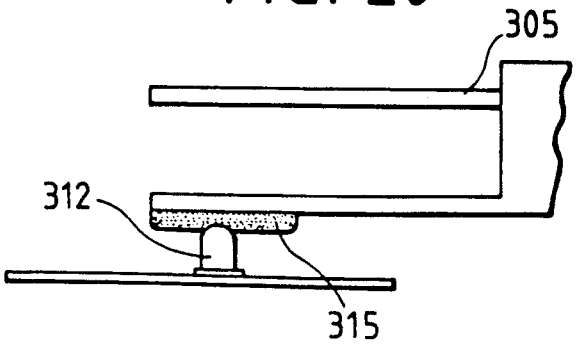
FIG. 20 is a diagram showing a fourth sensor cleaning embodiment.

A further embodiment is shown in FIG. 20, in which the cleaning member 315 is mounted on the bottom of the fingers 305 of the hand 13. This embodiment has the simplest construction of all the embodiments and thus the advantage of having the fewest number of components.

The preceding embodiments are directed to a cleaning method, in which the blotted sensors are detected at a specified interval early in the morning. The specified interval may fall midway of the running time of the apparatus, however, or when the visit of the customers is interrupted. In the latter situation, as will be described with reference to a fifth embodiment of the sensor cleaning apparatus shown in FIG. 21, the cleaning operation may be interrupted and then later retrieved. Thus, according to the present embodiment, the self-cleaning of the sensors can be initiated during the run of the apparatus.

If the contamination of the sensor is detected (i.e., if YES) at the step 402, the existence of the customer is checked at a step 411. If YES, the cleaning operation is interrupted at a step 412, and the paper dispensing operation is executed. The end of the paper dispensing or depositing operation is detected at a step 413, causing the routine to be returned to the step 102 for restarting the cleaning operation. Incidentally, if a NO determination is made at step 411 (no customer) in the flow chart of FIG. 21, the cleaning operation begins. The operation is divided into portions so that only a fraction of the total number of sensors is cleaned at once. After one fraction of the total number of sensors is cleaned, the routine is returned to the step 411. This prevents a long continuous cleaning operation from interfering With subsequent transactions.

What is claimed is:

1. An apparatus for handling sheets of paper, comprising:

depositing/dispensing means for receiving from an operator sheets of paper to be deposited into the apparatus and for dispensing sheets of paper to an operator from the apparatus;

storage box means for storing sheets of paper within the apparatus that are to be dispensed to an operator and for receiving sheets of paper that are deposited into the apparatus by an operator;

counting and inspecting means for counting out a number of sheets of paper that matches a number of sheets requested by an operator and for counting and inspecting sheets of paper deposited into the apparatus by an operator;

transporting means for transporting sheets of paper between said storage box means and said counting and inspection means, and between said counting and inspection means and said depositing/dispensing means;

control means for controlling said transporting means, said counting and inspecting means, and said depositing/dispensing means in accordance with a transaction requested by an operator and input means for inputting a transaction request by an operator;

said counting and inspecting means having a hopper unit for supporting a stack of sheets of paper, and a stacker unit for receiving and stacking the sheets of paper received from said hopper unit; and said hopper unit being separated from said stacker unit to form a space thereinbetween, said depositing/dispensing means being movably provided within said space.

2. An apparatus for handling sheets of paper according to claim 1, further comprising:

said depositing/dispensing means having movable mounting means for positioning said depositing/dispensing means in a first position wherein sheets of paper are deposited into the apparatus or dispensed to an operator and a second position wherein said depositing/dispensing means are accessible to said transporting means for delivering deposited sheets of paper to the transporting means and for receiving sheets of paper to be dispensed to an operator from said transporting means.

3. An apparatus for handling sheets of paper according to claim 2, wherein said movable mounting means is further for positioning said depositing/dispensing means in a third position outside of said space for allowing clearing of sheets of paper jammed in the apparatus and for maintenance of the apparatus by allowing access to components of the apparatus adjacent said space.

4. An apparatus for handling sheets of paper according to claim 2, wherein said movable mounting means comprises a pivot pin on which said depositing/dispensing means pivots between said first and second positions, said pivot pin extending vertically and said depositing/dispensing means pivoting in a horizontal plane.

5. An apparatus for handling sheets of paper according to claim 2, further comprising:

said inspecting and counting means further having a separator for separating single sheets of paper from the stack of sheets of paper stored in said hopper unit and for counting the separated single sheets; and a discriminator positioned between said separator and said stacker unit, said discriminator having hatch means opening into said space for providing access to said discriminator.

6. An apparatus for handling sheets of paper according to claim 5, further comprising:

means for conveying sheets of paper received from said discriminator to said stacker unit; and said conveying means being a conveyor belt and roller unit having access means for obtaining access to said belt and roller unit through said space such that jamming of sheets of paper in said belt and roller unit can be cleared.

7. An apparatus for handling sheets of paper according to claim 5, further comprising:

said separator and said discriminator being positioned under said stacker unit in said apparatus with said space formed thereinbetween; and conveying means extending between said separator and said stacker unit opposite said depositing/dispensing means for conveying sheets of paper from said separator to said stacking unit.

8. An apparatus for handling sheets of paper according to claim 1, further comprising:

said hopper unit having enclosure means for preventing access to the sheets of paper stacked within said hopper, said enclosure means having cover means for allowing access to said hopper unit for maintenance and having an opening allowing access to said hopper unit by said transporting means;

said cover means having means for locking said cover in a closed position to prevent access to said hopper unit and to allow access to said hopper unit by unlocking said locking means and opening said cover means.

9. An apparatus for handling sheets of paper according to claim 8, further comprising:

said hopper unit having shutter means mounted adjacent said opening and having means for opening and closing said shutter means, said opening and closing means further for normally closing said shutter means and for opening said shutter means only to allow access through said opening to said hopper unit for said transporting means to deliver sheets of paper to said hopper unit or remove sheets of paper from said hopper unit.

10. An apparatus for handling sheets of paper according to claim 1, further comprising:

enclosure means for enclosing said counting and inspecting means, including cover means for allowing access to said counting and inspecting means and for preventing access to said counting and inspecting means including means for locking said cover means such that access to said counting and inspecting means is prevented when said cover means is locked.

11. An apparatus for handling sheets of paper according to claim 1, further comprising:

said hopper unit having enclosure means for preventing access to said hopper unit and an opening allowing access to said hopper unit for said transporting means means; and shutter means mounted adjacent said opening, and means for extending said shutter means across said opening, said shutter means having a series of comb-shaped flanges that extend across said opening in an extended position;

said transporting means having finger means including cantilevered fingers spaced apart from one another, said extending means further for retracting said shutter means to open said shutter means such that said transporting means reaches inwardly into said hopper unit for delivering a stack of the sheets of paper supported on said finger means into said hopper and said extending means further for extending said comb-shaped flanges of said shutter means across said opening in between said finger means to push the stack of sheets of paper off the end of said finger means when said transporting means retracts outwardly of said hopper unit, whereby said shutter means extends across said opening after said transporting means is fully retracted from said hopper unit to close said opening preventing access to the sheets of paper stacked in said hopper unit.

12. An apparatus for handling sheets of paper according to claim 1, further comprising:

closure means for enclosing said stacker unit, including cover means for allowing access to said stacker unit and for preventing access to said stacker unit including means for locking said cover means such that access to said stacker unit is prevented when said cover means is locked.

13. A paper handling apparatus according to claim 1, wherein said counting and inspecting means further has a separator for separating single sheets of paper from the stack of sheets of paper stored in said hopper unit and for counting the separated single sheets.

14. An apparatus for handling sheets of paper, comprising:

depositing/dispensing means for receiving from an operator sheets of paper to be deposited into the apparatus and for dispensing sheets of paper to an operator from the apparatus;

storage box means for storing sheets of paper within the apparatus that are to be dispensed out to an operator, and for receiving sheets of paper that are deposited into the apparatus by an operator;

counting and inspecting means having a hopper unit for supporting a stack of the sheets of paper and a stacker unit for receiving and stacking the sheets of paper received from said hopper unit, and for counting out a number of sheets of paper that matches a number of sheets requested by an operator and further for counting and inspecting the sheets of paper deposited into the apparatus by an operator;

transporting means for transporting sheets of paper between said storage box means and said counting and inspecting means, and between said counting and inspecting means and said depositing/dispensing means;

control means for controlling said transporting means, said counting and inspecting means, and said depositing/dispensing means in accordance with a transaction requested by an operator and input means for inputting a transaction request by an operator;

sensor means for determining the presence of sheets of paper for at least one of said stacker unit, depositing/dispensing means, and hopper unit; said sensor means including transmitting and receiving sensors that provide an output signal when said receiving sensor receives a transmission from said transmitting sensor indicating that there is no sheets of paper between said transmitting and receiving sensors;

circuit means for testing said sensor means with a test signal to determine if an output signal of said sensor means falls below a predetermined threshold level in response to said test signal, said circuit means including comparator means for comparing said output signal to said threshold level and for producing a cleaning signal output when said sensor means output signal falls below the predetermined threshold level; and means responsive to said cleaning output signal for cleaning said sensor means.

15. An apparatus for handling sheets of paper according to claim 14, wherein said transmitting and receiving sensors are light emitting and receiving sensors, one of said sensors being mounted in an upper position, and the other of said sensors being mounted in a lower position relative to the upper position; and further wherein said sensor cleaning means is for cleaning the other of said sensors that is in said lower position relative to the upper position.

16. An apparatus for handling sheets of paper according to claim 14, wherein said sensor cleaning means comprises a lever having a cleaning member at one end thereof that is mounted adjacent one of the sensors for movement between an extended position and a retracted position, wherein said cleaning member cleans the surface of said one sensor and said lever is moved between the extended and retracted positions; and said transporting means having means for engaging said lever such that said transporting means moves said lever between said extended and retracted positions.

17. An apparatus for handling sheets of paper according to claim 14, wherein said sensor cleaning means comprises robot hand means having finger means for grasping a cleaning member such that said robot hand means wipes said cleaning member across the surface of said sensors.

18. An apparatus for handling two kinds of sheets of paper, comprising:

dispensing means for dispensing sheets of paper to an operator from the apparatus;

storage box means for storing the two kinds of paper within the apparatus;

counting and inspecting means for counting out a selected combined number of sheets of paper of kinds Y and X in accordance with an operator's dispensing transaction request, said counting and inspecting means having a first hopper for the Y kind of paper and a second hopper for the X kind of paper;

transporting means for transporting sheets of paper between said storage box means and said counting and inspecting means, and between said counting and inspecting mans and said dispensing means;

control means for controlling said transporting means, said counting and inspecting means, and said dispensing means in accordance with a dispensing transaction requested by an operator including input means for inputting a transaction request by an operator;

said counting and inspecting means having discriminator means for discriminating between the Y and X kinds of paper received from said hoppers and providing a determination of the kind, means for stacking including at least first and second stackers for stacking the paper of kinds Y and X respectively, and means for conveying sheets of paper of kinds Y and X through said counting and inspecting means from said hoppers to one of said first and second stackers in accordance with the determination of the kind of paper provided by said discriminator such that a stack of sheets of paper of the selected number of the respective kinds of paper Y and X are stacked in the first and second stackers respectively; and said transporting means further for transporting sheets of paper of kinds Y and X from said stackers to said dispensing means in a dispensing transaction for delivery to the operator.

19. An apparatus for handling two kinds of paper according to claim 18, further comprising:

said dispensing means being depositing/dispensing means further for receiving from an operator sheets of paper to be deposited into the apparatus;

said storage box means further for receiving paper currency that has been deposited into the apparatus by an operator, said storage box means having first and second spaces for storing the Y and X kinds of paper respectively;

said counting and inspecting means further for counting and inspecting sheets of paper deposited into the apparatus by an operator in a depositing transaction, said counting and inspecting means further having separator means for separating single sheets of paper from a stack of sheets of paper within each of said hoppers, said first and second hoppers having a stack of sheets of paper of kinds Y and X respectively stacked therein in preparation for a dispensing transaction;

said separator means further for counting out single sheets of paper of each kind as necessary from the respective ones of said first and second hoppers; and said transporting means further for transporting the total contents of said second hopper to said storage box means and for transporting paper deposited in said depositing/dispensing means to said second hopper, said separator means further for separating and counting the deposited paper, and said discriminator means further for discriminating the deposited paper, such that said conveying means conveys the deposited paper from said separator means through said discriminator means to the respective ones of said stackers in accordance with the determination of the kind of paper provided by said discriminator means; and said transporting means further for transporting the deposited sheets of paper from said stackers to said storage box means.

20. An apparatus for handling two kinds of paper according to claim 19, further comprising:

said storage box means having first and second spaces and an upper shelf and a push plate below said upper shelf such that said first space is between said upper shelf and a top board of said storage box means and said second space is above said push plate; and said storage box means further having first and second openings and means for moving said shelf from an initial position wherein said first space is formed between said upper shelf and said top board adjacent said first opening and said second opening is adjacent said second space to a second position wherein said shelf is moved upwardly by said moving means such that said first space is reduced to a minimum size and said second space is widened, whereby in a dispensing transaction said transporting means is further for first removing sheets of paper of kind X from said first space through said first opening for loading into said second hopper, and said transporting means is further for removing sheets of paper of kind Y from said second space and loading it into said first hopper.

21. An apparatus for handling two kinds of paper according to claim 20, wherein said moving means is further for moving said shelf to said initial position in a depositing transaction such that said first space is widened, said transporting means further for removing the total contents of said second hopper of said counting and inspecting means and delivering it to said first space through said first opening, and for transporting the papers to be deposited from said depositing/dispensing means to said second hopper of said counting and inspecting means such that the papers deposited are separated by said separator means, discriminated by said discriminator means and stacked in said stackers according to the kind of paper determined by said discriminator means, and said transporting means further for transporting the sheets of paper of kind X in said first space of said storage box means into said second hopper of said counting and inspecting means in preparation for a dispensing transaction.

22. An apparatus for handling two kinds of paper according to claim 20, wherein said push plate that supports a stack of sheets of paper of kind Y in said second space of said storage box means has means for moving said push plate upwardly in accordance with the size of the stack of paper of kind Y in said second space such that a portion of the stack of paper in said second space is accessible to said transporting means through said second opening when said shelf is in said second position.

23. An apparatus for handling two kinds of paper according to claim 20, further comprising:

dividing pawl means for dividing a portion of the stack of paper of kind Y in said second space from the remainder of the stack, said transporting means further for removing said divided portion through said second opening and transporting it to said first hopper for loading said first hopper in preparation for a dispensing transaction.

24. An apparatus for handling two kinds of paper according to claim 23, wherein said storage box means has a third opening opposite said second opening for allowing entrance of said dividing pawl means into said storage box means.

25. An apparatus for handling two kinds of paper according to claim 18, wherein said storage box means has first and second spaces for storing the Y and X kinds of paper respectively, a top board and a movable upper shelf, wherein said first space is between said upper shelf and said top board, and a lower support plate wherein said second space is above said lower support plate;

said storage box means further having first and second openings for providing access to the sheets of paper stacked within said first and second spaces by said transporting means, said first space having the X kind of paper and being evacuated by said transporting means to fill said second hopper for a paying transaction, and means for moving said upper shelf to reduce the size of said first space after the sheets of paper have been evacuated from it and to correspondingly widen said second space.

26. An apparatus for handling two kinds of paper according to claim 25, further comprising:

said openings of said storage box means each having shutter means including first and second shutters, wherein said first shutter is movable between an open position and a position closing said openings and wherein said second shutter has a series of comb-shaped flanges;

said transporting means having finger means including cantilevered fingers spaced apart from one another; and means for moving said shutters so that said first and second openings are normally closed by said first shutters respectively and open when said transporting means enters said first and second spaces respectively, said transporting means further for delivering stacks of sheets of paper of kinds X and Y respectively to said first and second spaces by entering said storage box means through one of said openings with a stack of sheets of paper supported thereon and retracting outwardly after said shutter moving means extends said second shutter across said one opening with said comb-shaped flanges intersecting said finger means such that the stack of sheets of paper is left behind within the space as the transporting means leaves through said one opening.

27. An apparatus for handling two kinds of paper according to claim 18, further comprising:

said storage box means having first and second spaces and an upper shelf and a push plate below said upper shelf such that said first space is between said upper shelf and a top board of said storage box means and said second space is above said push plate; and said storage box means further having first and second openings and means for moving said shelf from an initial position wherein said first space is formed between said upper shelf and said top board adjacent said first opening and said second opening is adjacent said second space to a second position wherein said shelf is moved upwardly by said moving means such that said first space is reduced to a minimum size and said second space is widened, whereby in a dispensing transaction said transporting means is further for first removing sheets of paper of kind X from said first space through said first opening for loading into said second hopper, and said transporting means is further for removing sheets of paper of kind Y from said second space and loading it into said first hopper.

28. An automatic cash transacting machine according to claim 27, further comprising said transporting means having finger means, and said upper shelf and said push plate having a series of grooves for receiving said finger means such that said finger means of said transporting means slide under the stack of sheets of paper when the sheets of paper are removed.

29. An apparatus for handling at least two kinds of paper according to claim 18, wherein said counting and inspecting means further has separating means for separating single sheets of paper from a stack of sheets of paper within each of said hoppers, said separating means being positioned between said first and second hoppers and having tow rollers for advancing single sheets of paper from one of said first and second hoppers when said rollers are driven in a first rotational direction, and means for advancing single sheets of paper from the other of said hoppers when said rollers are driven in an opposite rotational direction.

30. An apparatus for handling sheets of paper, comprising:

depositing/dispensing means for receiving from an operator sheets of paper to be deposited into the apparatus and for dispensing sheets of paper to an operator from the apparatus;

storage box means for storing sheets of paper within the apparatus;

counting and inspecting means for counting and inspecting sheets of paper in accordance with a transaction requested by an operator;

transporting means for transporting sheets of paper between said storage box means and said counting and inspection means, and between said counting and inspection means and said depositing/dispensing means;

control means for controlling said transporting means, said counting and inspecting means, and said depositing/dispensing mans in accordance with said transaction requested by an operator, and input means for inputting said transaction requested by an operator;

said storage box means further having at least one opening for providing access to the sheets of paper stacked therein by said transporting means;

said opening of said storage box means having a shutter, wherein said shutter has a series of comb-shaped flanges;

said transporting means having finger means including cantilevered fingers spaced apart form one another; and means for moving said shutter from an open position to a position wherein said comb-shaped flanges extend across said opening whereby said shutter moving means extends said shutter across said one opening with said comb-shaped flanges intersecting said finger means such that the stack of sheets of paper is left behind within said storage box means after said transporting means leaves through said one opening.

31. An apparatus for handling sheets of paper according to claim 30, wherein said counting and inspecting means has a hopper unit for supporting a stack of sheets of paper, said hopper unit having shutter means mounted adjacent said hopper unit opening and having means for opening and closing said shutter means, said opening and closing means further for normally closing said shutter means and for opening said shutter means only to allow access through said opening to said hopper unit for said transporting means to deliver sheets of paper to said hopper unit or to remove sheets of paper from said hopper unit.

32. An apparatus for handling sheets of paper, comprising:

depositing/dispensing mans for receiving from an operator sheets of paper to be deposited into the apparatus and for dispensing sheets of paper to an operator from the apparatus;

storage box means for storing sheets of paper within the apparatus that are to be dispensed to an operator and for receiving at least one kind of sheets of paper that are to be deposited into the apparatus by an operator;

counting and inspecting means for counting and inspecting sheets of paper in accordance with a transaction requested by an operator;

transporting means for transporting sheets of paper between said storage box means and said counting and inspecting means, and between said counting and inspecting means and said depositing/dispensing means;

control means for controlling said transporting means, said counting and inspecting means, and said depositing/dispensing means in accordance with said transaction requested by an operator and input means for inputting said transaction request by an operator;

said counting and inspecting means further having separately functioning units, including a separator and discriminator unit having a hopper for accepting and supporting a stack of sheets of paper transported therein by said transporting means and having an exit for single sheets of paper that have been separated and discriminated from the stack of sheets of paper in said hopper; a conveying unit; and a stacker unit wherein said separated and discriminated sheets of paper exiting said separator and discriminator unit enter said conveying unit and are conveyed to said stacker unit through said conveying unit to be stacked in said stacker unit.

33. A paper handling apparatus according to claim 32, wherein one of said stacker unit and said separator and discriminator unit is positioned above the other, and said conveying unit is positioned to one side of both of said stacker unit and said separator and discriminator unit.

34. A paper handling apparatus according to claim 32, wherein one of said separator and discriminator unit and said stacker unit is positioned above and t one side of the other of said units, and said conveying unit is positioned between each of said units.

35. A paper handling apparatus according to claim 34, wherein said conveying unit is said transporting means.

36. An apparatus for handling at least two kinds of sheets of paper, comprising:

dispensing mans for dispensing sheets of paper to an operator from the apparatus;

storage box means for storing the two kinds of paper within the apparatus;

counting and inspecting means for counting out a selected combined number of sheets of paper of kinds Y and X in accordance with an operator's dispensing transaction request, said counting and inspecting means having a first hopper for the Y kind of paper and a second hopper for the X kind of paper;

transporting means for transporting sheets of paper between said storage box means and said counting and inspecting means, and between said counting and inspecting means and said dispensing means;

control means for controlling said transporting means, said counting and inspecting means, and said dispensing means in accordance with said dispensing transaction requested by an operator including input means for inputting said transaction request by an operator; and said transporting means further for transporting sheets of paper of kinds Y and X from said counting and inspecting means to said dispensing means in a dispensing transaction for delivery to the operator.

37. A paper handling apparatus according to claim 36, wherein said counting and inspecting means has discriminator means for discriminating between the Y and X kinds of paper received from said hoppers and providing a determination of the kind, means for stacking including at least first and second stacker for stacking the paper of kinds Y and X respectively, and means for conveying sheets of paper of kinds Y and X through said counting and inspecting means from said hoppers to one of said first and second stackers in accordance with the determination of the kind of paper provided by said discriminator such that a stack of sheets of paper of the selected number of the respective kinds of paper Y and X are stacked in the first and second stackers respectively; and said counting and inspecting means further having separator means for separating single sheets of paper from a stack of sheets of paper within each of said hoppers.

38. An apparatus having height, width and depth dimensions for handling sheets of paper having length and width dimensions, comprising:

depositing/dispensing means for receiving from an operator sheets of paper to be deposited into the apparatus and for dispensing sheets of paper to an operator from the apparatus;

storage box means for storing sheets of paper within the apparatus that are to be dispensed to an operator and for receiving sheets of paper that are to be deposited into the apparatus by an operator;

counting and inspecting means for counting and inspecting sheets of paper in accordance with a transaction requested by an operator;

transporting means for transporting sheets of paper between said storage box means and said counting and inspecting means, and between said counting and inspecting means and said depositing/dispensing means;

control means for controlling said transporting means, said counting and inspecting means, and said depositing/dispensing means in accordance with a transaction requested by an operator;

said counting and inspecting means having a separator and discriminator unit having a hopper for supporting a stack of sheets of paper, a stacker unit, and conveying means extending in the width direction of the apparatus between said separator and discriminator unit and stacker unit wherein sheets of paper are stacked in said hopper unit, stacked in said stacker unit, and conveyed in said conveying means in the width direction of the apparatus with the length dimension of the sheets of paper extending in the depth direction of the apparatus whereby the depth dimension of said counting and inspecting means is minimized with respect to the length dimension of the sheets of paper.

39. An apparatus for handling sheets of paper according to claim 38, wherein said transporting means is positioned laterally in the width direction of the apparatus with respect to the depth dimension of the apparatus and of said counting and inspecting means for transporting the sheets of paper by said transporting means with the length dimension of the sheets of paper extending in the direction of the depth dimension of the apparatus whereby the depth dimension of the apparatus is minimized with respect to the length dimension of the sheets of paper.

40. An apparatus for handling sheets of paper, comprising:

dispensing means for dispensing sheets of paper to an operator from the apparatus;

storage box means for storing sheets of paper within the apparatus that are to be dispensed to an operator;

counting means for counting out a number of sheets of paper that matches the number of sheets requested by an operator;

transporting means for transporting sheets of paper between said storage box means and said counting means, and between said counting means and said dispensing means;

control means for controlling said transporting means, said counting means, and said dispensing means in accordance with a transaction requested by an operator and input means for inputting a transaction requested by an operator;

said counting means having a hopper unit for supporting a stack of sheets of paper, and a stacker unit for receiving and stacking the sheets of paper received from said hopper unit; and said hopper unit being separated from said stacker unit to form a space thereinbetween, said dispensing means being movably provided within said space.

41. An apparatus for handling sheets of paper according to claim 40, further comprising:

closure means for enclosing said stacker unit, including cover means for allowing access to said stacker unit and for preventing access to said stacker unit including means for locking said cover means such that access to said stacker unit is prevented when said cover means is locked.

42. An apparatus for handling sheets of paper, comprising:

depositing/dispensing means for receiving from an operator sheets of paper to be deposited into the apparatus and for dispensing sheets of paper to an operator from the apparatus;

storage box means for storing sheets of paper that are to be dispensed to an operator and for receiving sheets of paper that are deposited into the apparatus by an operator;

counting and inspecting means for counting and inspecting sheets of paper in accordance with a transaction requested by an operator;

transporting means for transporting sheets of paper between said storage box means and said counting and inspection means, and between said counting and inspection means and said depositing/dispensing means;

control means for controlling said transporting means, said counting and inspecting means, and said depositing/dispensing means in accordance with a transaction requested by an operator;

said counting and inspecting means having a space therein to movably contain said depositing/dispensing means.

43. An apparatus for handling sheets of paper according to claim 42, further comprising:

closure means for enclosing said counting and inspecting means, including cover means for allowing access to said counting and inspecting means and for preventing access to said counting and inspecting means including means for locking said cover means such that access to said counting and inspecting means is prevented when said cover means is locked.

44. An apparatus for handling sheets of paper according to claim 42, wherein said storage box means is positioned underneath said counting and inspecting means with respect to a transporting direction of sheets of paper with said transporting means between said storage box means and said counting and inspecting means.

45. A paper handling apparatus according to claim 42, further comprising:

said counting and inspecting means having a separator and discriminator unit and a conveying unit for conveying papers from said separator and discriminator unit, whereby said space provides access to each of said units for allowing clearing of sheets of paper jammed in said unit.

46. An apparatus for handling sheets of paper according to claim 45, wherein said separator unit, conveying unit and stacker unit are arranged in a C-shape with one of said stacker unit and said separator and discriminator unit being positioned above the other, and said conveying unit being positioned to one side of both said separator and discriminator unit and said stacker unit.

47. An apparatus for handling sheets of paper according to claim 42, further comprising:

means for dividing and separating a top portion of a stack of sheets of paper stored in said storage box from a remainder of the stack by a predetermined distance sufficient to allow said transporting means to remove the upper portion of the stack from the storage box.

48. An apparatus for handling sheets of paper according to claim 47, wherein said dividing means includes a wedge shaped dividing pawl and means for moving said dividing pawl into engagement with the stack of sheets of paper stored in said storage box such that as said dividing pawl moves into the stack the upper portion is separated from the remainder of the stack, said dividing pawl engaging the stack of sheets of paper from one direction and said transporting means removing sheets of paper from said storage box from a second direction opposite said first direction.

49. An apparatus for handling sheets of paper, comprising:

dispensing means for dispensing sheets of paper to an operator from the apparatus;

storage box means for storing sheets of paper that are to be dispensed to an operator;

counting means for counting sheets of paper in accordance with a transaction requested by an operator;

transporting means for transporting sheets of paper between said storage box means and said counting means, and between said counting means and said dispensing means;

control means for controlling said transporting means, said counting means, and said dispensing means in accordance with a transaction requested by an operator;

said counting means having a space therein to movably contain said dispensing means.

50. An apparatus for handling sheets of paper according to claim 49, further comprising:

closure means for enclosing said counting means including cover means for allowing access to said counting means and for preventing access to said counting means including means for locking said cover means such that access to said counting means is prevented when said cover means is locked.

51. An apparatus for handling sheets of paper according to claim 49, wherein said storage box means is positioned underneath said counting means with respect to a transporting direction of sheets of paper with said transporting means between said storage box means and said counting means.

52. A paper handling apparatus according to claim 49, further comprising:

said counting means having a separator and counter unit and a conveying unit for conveying papers from said separator and counter unit, whereby said space provides access to each of said units for allowing clearing of sheets of paper jammed in said unit.

53. A paper handling apparatus according to claim 49, further comprising:

means for dividing and separating a top portion of a stack of sheets of paper stored in said storage box means from a remainder of the stack by a predetermined distance sufficient to allow said transporting means to remove the upper portion of the stack from the storage box means.

54. A paper handling apparatus according to claim 53, wherein said dividing means includes a wedge shaped dividing pawl and means for moving said dividing pawl into engagement with the stack of sheets of paper stored in said storage box means such that as said dividing pawl moves into the stack the upper portion is separated from the remainder of the stack, said dividing pawl engaging the stack of sheets of paper from one direction and said transporting means removing sheets of paper form said storage box means from a second direction opposite said first direction.

55. An apparatus for handling sheets of paper, comprising:

dispensing means for dispensing sheets of paper to an operator form the apparatus;

storage box means for storing sheets of paper that are to be dispensed to an operator;

counting and inspecting means for counting and inspecting sheets of paper in accordance with a transaction requested by an operator;

transporting means for transporting sheets of paper between said storage box means and said counting means, and between said counting means and said dispensing means;

control means for controlling said transporting means, said counting means, and said dispensing means in accordance with a transaction requested by an operator;

said counting means further having separately functioning units, including a separator and counter unit having a hopper for accepting and supporting a stack of sheets of paper transported therein by said transporting means and having an exit for single sheets of paper that have been separated and counted from the stack of sheets of paper in said hopper; a conveying unit; and a stacker unit wherein said separated and counted sheets of paper exiting said separator and counter unit enter said conveying unit and are conveyed to said stacker unit through said conveying unit to be stacked in said stacker unit.

56. An apparatus having height, width and depth dimensions for handling sheets of paper having length and width dimensions, comprising:

dispensing means for dispensing sheets of paper to an operator from the apparatus;

storage box means for storing sheets of paper within the apparatus that are to be dispensed to an operator;

counting means for counting sheets of paper in accordance with a transaction requested by an operator;

transporting means for transporting sheets of paper between said storage box means and said counting means, and between said counting means and said dispensing means;

control means for controlling said transporting means, said counting means, and said dispensing means in accordance with a transaction requested by an operator;

said counting means having a separator and counter unit having a hopper for supporting a stack of sheets of paper, a stacker unit, and conveying means extending in the width direction of the apparatus between said separator and counter unit and said stacker unit, wherein sheets of paper are stacked in said hopper, stacked in said stacker unit, and conveyed in said conveying means in the width direction of the apparatus with the length dimension of the sheets of paper extending in the depth direction of the apparatus whereby the depth dimension of said counting means is minimized with respect to the length dimension of the sheets of paper.

57. An apparatus for handling sheets of paper according to claim 56, wherein said transporting means is positioned laterally in the width direction of the apparatus with respect to the depth dimension of the apparatus and of said counting means for transporting the sheets of paper by said transporting means with the length dimension of the sheets of paper extending in the direction of the depth dimension of the apparatus whereby the depth dimension of the apparatus is minimized with respect to the length dimension of the sheets of paper.

58. A method of handling sheets of paper having length and width dimensions in an apparatus having height, width and depth dimensions, comprising the steps of:

depositing sheets of paper received form an operator into the apparatus and dispensing sheets of paper to an operator from the apparatus through a depositing/dispensing port;

storing sheets of paper within the apparatus that are to be dispensed to an operator and receiving sheets of paper that are to be deposited into the apparatus by an operator in a storage box;

counting and inspecting sheets of paper with a counter and inspection unit in accordance with a transaction requested by an operator;

transporting sheets of paper between said storage box and said counter and inspection unit, and between said counter and inspection unit and said depositing/dispensing port;

controlling said transporting means, said counter and inspection unit, and said depositing/dispensing port in accordance with a transaction requested by an operator;

supporting a stack of sheets of paper in a hopper of said counter and inspection unit, conveying in the width direction of the apparatus sheets of paper supported in said hopper through a separator and discriminator unit of said counter and inspection unit to a stacker unit with the length dimension of the sheets of paper extending in the depth direction of the apparatus; and transporting the sheets of paper with a robot positioned laterally with respect to the depth dimension of the apparatus and of the counter and inspection unit so that the sheets of paper are transported by the robot with the length dimension of the sheets of paper extending in the direction of the depth dimension of the apparatus whereby the depth dimension of the apparatus is minimized with respect to the length dimension of the sheets of paper.

59. A method of handling sheets of paper having length and width dimensions in an apparatus having height, width and depth dimensions, comprising the steps of:

dispensing sheets of paper to an operator from the apparatus through a dispensing port;

storing sheets of paper within a storage box in the apparatus that are to be dispensed to an operator;

counting sheets of paper with a counter unit in accordance with a transaction requested by an operator;

transporting sheets of paper between the storage box and the counter unit, and between the counter unit and the dispensing port;

controlling said transporting, said counting, and said dispensing in accordance with a transaction requested by an operator;

supporting a stack of sheets of paper in a hopper of the counter unit, conveying in the width direction of the apparatus sheets of paper supported in the hopper through a separator unit of the counter unit to a stacker unit with the length dimension of the sheets of paper extending in the depth direction of the apparatus; and transporting the sheets of paper with a robot positioned laterally with respect to the depth dimension of the apparatus and of the counter unit so that the sheets of paper are transported by the robot with the length dimension of the sheets of paper extending in the direction of the depth dimension of the apparatus whereby the depth dimension of the apparatus is minimized with respect to the length dimension of the sheets of paper.

* * * * *